US008984726B2

(12) United States Patent
Ogawa et al.

(10) Patent No.: US 8,984,726 B2
(45) Date of Patent: Mar. 24, 2015

(54) METHOD OF MANUFACTURING AUTOMOBILE DOOR HINGE

(71) Applicants: Hiroshi Ogawa, Wakayama (JP); Kazuya Ogawa, Wakayama (JP)

(72) Inventors: Hiroshi Ogawa, Wakayama (JP); Kazuya Ogawa, Wakayama (JP); Michihiro Yokoyama, Tokyo (JP)

(73) Assignees: Hiroshi Ogawa, Wakayama (JP); Kazuya Ogawa, Wakayama (JP)

( * ) Notice: Subject to any disclaimer, the term of this patent is extended or adjusted under 35 U.S.C. 154(b) by 0 days.

(21) Appl. No.: 13/918,098

(22) Filed: Jun. 14, 2013

(65) Prior Publication Data

US 2013/0276276 A1 Oct. 24, 2013

Related U.S. Application Data

(63) Continuation of application No. PCT/JP2011/078240, filed on Dec. 7, 2011.

(30) Foreign Application Priority Data

Dec. 17, 2010 (JP) ..... 2010-281433

(51) Int. Cl.
*B21D 53/40* (2006.01)
*E05D 5/06* (2006.01)

(Continued)

(52) U.S. Cl.
CPC ..... *E05D 5/062* (2013.01); *B21D 53/40* (2013.01); *B21D 53/88* (2013.01); *B21J 5/02* (2013.01);

(Continued)

(58) Field of Classification Search
CPC ..... E05D 5/062; E05D 11/00; E05D 9/00; B21D 53/40; B21D 53/88; B21K 13/02; B21K 1/74; B21J 5/02; B21J 5/10; E05Y 2800/465
USPC ..... 29/11; 72/356, 360, 355.2, 355.4, 352; 16/387, 389, 254; 219/149, 50, 56, 219/152, 154
See application file for complete search history.

(56) References Cited

U.S. PATENT DOCUMENTS

2006/0288754 A1 12/2006 Otaki

FOREIGN PATENT DOCUMENTS

CN 101574721 A * 11/2009
EP 0 054 522 6/1982

(Continued)

OTHER PUBLICATIONS

International Search Report issued Feb. 7, 2012 in corresponding International Application No. PCT/JP2011/078240.

*Primary Examiner* — David Bryant
*Assistant Examiner* — Ruth G Hidalgo-Hernande
(74) *Attorney, Agent, or Firm* — Wenderoth, Lind & Ponack, L.L.P.

(57) ABSTRACT

A method of manufacturing an automobile door hinge includes hot forging a round steel bar to form a forged workpiece including a mounting portion, an arm portion, and a column portion, and forming a shaft hole by punching the column portion by using a special die and a punch. The die has a gap formed therein so that, during punching, a slug is not generated and the column portion expands outward when the punch is pressed from a punching start point to a predetermined dimension, and a slug is generated and discharged when the punch is pressed from the predetermined dimension to a punching end point.

4 Claims, 34 Drawing Sheets

(51) Int. Cl.

| | |
|---|---|
| ***B21D 53/88*** | (2006.01) |
| ***B21J 5/02*** | (2006.01) |
| ***B21J 5/10*** | (2006.01) |
| ***B21K 1/74*** | (2006.01) |
| ***B21K 13/02*** | (2006.01) |
| ***E05D 11/00*** | (2006.01) |
| ***E05D 9/00*** | (2006.01) |
| ***B21K 23/00*** | (2006.01) |

(52) U.S. Cl.

CPC ... *B21J 5/10* (2013.01); *B21K 1/74* (2013.01); *B21K 13/02* (2013.01); *E05D 11/00* (2013.01); *E05D 9/00* (2013.01); *B21K 23/00* (2013.01); *E05Y 2800/465* (2013.01)

USPC ..... 29/11; 72/360; 72/356; 72/355.4; 72/352

(56) References Cited

FOREIGN PATENT DOCUMENTS

| | | |
|---|---|---|
| JP | 57-127541 | 8/1982 |
| JP | 5-44765 | 6/1993 |
| JP | 8-197952 | 8/1996 |
| JP | 10-205200 | 8/1998 |
| JP | 2008-223247 | 9/2008 |
| WO | 2006/126622 | 11/2006 |

* cited by examiner

METHOD OF MANUFACTURING AUTOMOBILE DOOR HINGE

TECHNICAL FIELD

The present invention relates to a method of manufacturing an automobile door hinge through a process including hot forging and punching, the automobile door hinge being made of steel and including a strip-shaped mounting portion and a cylindrical engagement portion that has a shaft hole into which a hinge pin is to be inserted. In particular, the present invention relates to a method of manufacturing an automobile door hinge with which a shaft hole, into which a hinge pin is to be inserted, can be formed so as to extend through the axial center of a column portion, which is formed by hot forging and which has a horizontal cross section having a circular or elliptical shape, by using a special punch and die so that the shaft hole has a height that is twice the diameter thereof or larger. With this method, an automobile door hinge having sufficient strength can be manufactured at low cost.

BACKGROUND ART

To date, automobile door hinges made from sheet metal have been widely used, because they can be manufactured at low cost by press-forming or the like (see, for example, PTL 1).

The strength of existing automobile door hinges made from sheet metal is low. Therefore, door hinges used for large-sized cars or luxury cars, which have heavy doors, are made by cutting an extruded steel material to a predetermined length and by machining the cut steel material into a predetermined shape (see, for example, PTL 2).

CITATION LIST

Patent Literature

PTL 1: Japanese Unexamined Patent Application Publication No. 8-197952 (paragraph 0012, FIG. 2)

PTL 2: Japanese Unexamined Patent Application Publication No. 2008-223247 (paragraph 0002, FIG. 4)

SUMMARY OF INVENTION

Technical Problem

The automobile door hinge described in PTL 1, which is made from sheet metal, has a bent portion having a small thickness, and a large bending moment is applied to the bent portion. Therefore, the bent portion may be easily damaged due to a shock that occurs when the door is opened or closed.

Moreover, a hinge shaft, which rotatably connects a body-side door hinge to a door-side door hinge, is exposed to the outside. Therefore, stress concentrates on the hinge shaft when the door rotates, and the hinge shaft may be easily broken.

As described above, automobile door hinges made from sheet metal have a problem of low strength, although they are inexpensive.

The automobile door hinge described in PTL 2, which is made by machining, has sufficient strength. However, the automobile door hinge has a problem that the cost of an extruded steel material is high and the cost of machining is high, and therefore the overall manufacturing cost is high.

An object of the present invention, which address such problems of the existing technologies, is to provide a method with which an automobile door hinge having sufficient strength can be manufactured at low cost. The method includes hot forging a round steel bar to form a strip-shaped mounting portion and a column portion, which has a horizontal cross section having a circular or elliptical shape; and forming a shaft hole, into which a hinge pin is to be inserted, in the column portion so as to extend through the axial center of the column portion by using a special punch and die so that the shaft hole has a height that is twice the diameter thereof or larger.

Solution to Problem

According to the present invention, there is provided a method of manufacturing an automobile door hinge through a process including hot forging and punching, the automobile door hinge being made of steel and including a strip-shaped mounting portion, a strip-shaped arm portion that is bent away from the mounting portion, and an engagement portion that is disposed at an end of the arm portion and that has a cylindrical shape, the engagement portion having a shaft hole into which a hinge pin is to be inserted, the method including:

a hot forging step of hot forging a round steel bar to form a strip-shaped mounting portion, a strip-shaped arm portion that is bent away from the mounting portion, and a column portion that is disposed at an end of the arm portion and that has a horizontal cross section having a circular or elliptical shape;

a shaft hole forming step of forming a shaft hole, into which a hinge pin is to be inserted, in the column portion formed in the hot forging step by using a first punch and a first die so that the shaft hole extends through an axial center of the column portion; and a shaft hole finishing step of punching the shaft hole formed in the shaft hole forming step by using a second punch and a second die from a side of the shaft hole on which a punching end point exists at which punching with the first punch has been finished, wherein, in the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies, wherein the lower die has a concave portion for receiving a protruding surface on a protruding side of a bent portion of the forged workpiece to be formed in the hot forging step so that the bent portion of the forged workpiece protrudes downward, wherein the upper die has a convex portion whose shape matches that of an opposite surface of the bent portion of the forged workpiece opposite to the protruding surface, wherein a height of the shaft hole formed in the shaft hole forming step in the column portion is 2.0 times a diameter of the shaft hole or larger, wherein the first punch used in the shaft hole forming step includes a tip having a conical shape having a vertex angle in a range of 70° to 120°, wherein the first die has an inner side wall that is separated from an outer periphery of the column portion of the forged workpiece with a gap therebetween, and a gap volume that is provided between the outer periphery of the column portion and the inner side wall has such a size that, during punching of the column portion of the forged workpiece using the first punch, a slug is not generated and the column portion expands outward when the first punch is pressed into the column portion from a punching start point to a predetermined dimension, and a slug is generated and discharged when the first punch is pressed into the column portion from the predetermined dimension to the punching end point, wherein the second die has substantially the same shape as the first die, and wherein the second punch includes a tip having a frusto-conical or conical shape having a vertex angle in a range of 70° to 120°, and the second punch has a maximum diameter that is larger than a maximum diameter of the first punch by 0.1 to 0.3 mm.

According to the present invention, there is further provided a method of manufacturing an automobile door hinge through a process including hot forging and punching, the automobile door hinge being made of steel and including a strip-shaped mounting portion, a strip-shaped arm portion that is bent away from the mounting portion, and a protrusion-including engagement portion that is disposed at an end of the arm portion and that has a cylindrical shape, the protrusion-including engagement portion having a shaft hole into which a hinge pin is to be inserted and a door stop protrusion on a distal side of the cylindrical shape, the method including:

a hot forging step of hot forging a round steel bar to form a strip-shaped mounting portion, a strip-shaped arm portion that is bent away from the mounting portion, and a protrusion-including column portion that is disposed at an end of the arm portion and that has a horizontal cross section having a circular or elliptical shape, the protrusion-including column portion having a door stop protrusion on a distal side of the circular or elliptical shape;

a shaft hole forming step of forming a shaft hole, into which a hinge pin is to be inserted, in the protrusion-including column portion formed in the hot forging step by using a first punch and a first die so that the shaft hole extends through an axial center of the protrusion-including column portion; and a shaft hole finishing step of punching the shaft hole formed in the shaft hole forming step by using a second punch and a second die from a side of the shaft hole on which a punching end point exists at which punching with the first punch has been finished, wherein, in the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies, wherein the lower die has a concave portion for receiving a protruding surface on a protruding side of a bent portion of the forged workpiece to be formed in the hot forging step so that the bent portion of the forged workpiece protrudes downward, wherein the upper die has a convex portion whose shape matches that of an opposite surface of the bent portion of the forged workpiece opposite to the protruding surface, wherein a height of the shaft hole formed in the shaft hole forming step in the protrusion-including column portion is 2.0 times a diameter of the shaft hole or larger, wherein the first punch used in the shaft hole forming step includes a tip having a conical shape having a vertex angle in a range of 70° to 120°, wherein the first die has an inner side wall that is separated from an outer periphery of the protrusion-including column portion of the forged workpiece with a gap therebetween, and a gap volume that is provided between the outer periphery of the protrusion-including column portion and the inner side wall has such a size that, during punching of the protrusion-including column portion of the forged workpiece using the first punch, a slug is not generated and the protrusion-including column portion expands outward when the first punch is pressed into the protrusion-including column portion from a punching start point to a predetermined dimension, and a slug is generated and discharged when the first punch is pressed into the protrusion-including column portion from the predetermined dimension to the punching end point, wherein the second die has substantially the same shape as the first die, and wherein the second punch includes a tip having a frusto-conical or conical shape having a vertex angle in a range of 70° to 120°, and the second punch has a maximum diameter that is larger than a maximum diameter of the first punch by 0.1 to 0.3 mm.

According to the present invention, there is further provided a method of manufacturing an automobile door hinge through a process including hot forging and punching, the automobile door hinge being made of steel and including a polygonal plate-shaped mounting portion, a strip-shaped arm portion that is bent away from the mounting portion and that has a dimension smaller than a height dimension of the mounting portion, and an engagement portion that is disposed at an end of the arm portion and that has a cylindrical shape, the engagement portion having a shaft hole into which a hinge pin is to be inserted, the method including:

a hot forging step of hot forging a round steel bar to form a polygonal plate-shaped mounting portion, a strip-shaped arm portion that is bent away from the mounting portion and that has a dimension smaller than a height dimension of the mounting portion, and a column portion that is disposed at an end of the arm portion and that has a horizontal cross section having a circular or elliptical shape;

a shaft hole forming step of forming a shaft hole, into which a hinge pin is to be inserted, in the column portion formed in the hot forging step by using a first punch and a first die so that the shaft hole extends through an axial center of the column portion; and a shaft hole finishing step of punching the shaft hole formed in the shaft hole forming step by using a second punch and a second die from a side of the shaft hole on which a punching end point exists at which punching with the first punch has been finished, wherein, in the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies, wherein the lower die has a concave portion for receiving a protruding surface on a protruding side of a bent portion of the forged workpiece to be formed in the hot forging step so that the bent portion of the forged workpiece protrudes downward, wherein the upper die has a convex portion whose shape matches that of an opposite surface of the bent portion of the forged workpiece opposite to the protruding surface, wherein a height of the shaft hole formed in the shaft hole forming step in the column portion is 2.0 times a diameter of the shaft hole or larger, wherein the first punch used in the shaft hole forming step includes a tip having a conical shape having a vertex angle in a range of 70° to 120°, wherein the first die has an inner side wall that is separated from an outer periphery of the column portion of the forged workpiece with a gap therebetween, and a gap volume that is provided between the outer periphery of the column portion and the inner side wall has such a size that, during punching of the column portion of the forged workpiece using the first punch, a slug is not generated and the column portion expands outward when the first punch is pressed into the column portion from a punching start point to a predetermined dimension, and a slug is generated and discharged when the first punch is pressed into the column portion from the predetermined dimension to the punching end point, wherein the second die has substantially the same shape as the first die, and wherein the second punch includes a tip having a frusto-conical or conical shape having a vertex angle in a range of 70° to 120°, and the second punch has a maximum diameter that is larger than a maximum diameter of the first punch by 0.1 to 0.3 mm.

According to the present invention, there is further provided a method of manufacturing an automobile door hinge through a process including hot forging and punching, the automobile door hinge being made of steel and including a polygonal plate-shaped mounting portion, a strip-shaped arm portion that is bent away from the mounting portion and that has a dimension smaller than a height dimension of the mounting portion, a protrusion-including engagement portion that is disposed at an end of the arm portion and that has a cylindrical shape, the protrusion-including engagement portion having a shaft hole into which a hinge pin is to be inserted and a door stop protrusion on a distal side of the cylindrical shape, the method including:

a hot forging step of hot forging a round steel bar to form a polygonal plate-shaped mounting portion, a strip-shaped arm portion that is bent away from the mounting portion and that has a dimension smaller than a height dimension of the mounting portion, and a protrusion-including column portion that is disposed at an end of the arm portion and that has a horizontal cross section having a circular or elliptical shape, the protrusion-including column portion having a door stop protrusion on a distal side of the circular or elliptical shape;

a shaft hole forming step of forming a shaft hole, into which a hinge pin is to be inserted, in the protrusion-including column portion formed in the hot forging step by using a first punch and a first die so that the shaft hole extends through an axial center of the protrusion-including column portion; and a shaft hole finishing step of punching the shaft hole formed in the shaft hole forming step by using a second punch and a second die from a side of the shaft hole on which a punching end point exists at which punching with the first punch has been finished, wherein, in the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies, wherein the lower die has a concave portion for receiving a protruding surface on a protruding side of a bent portion of the forged workpiece to be formed in the hot forging step so that the bent portion of the forged workpiece protrudes downward, wherein the upper die has a convex portion whose shape matches that of an opposite surface of the bent portion of the forged workpiece opposite to the protruding surface, wherein a height of the shaft hole formed in the shaft hole forming step in the protrusion-including column portion is 2.0 times a diameter of the shaft hole or larger, wherein the first punch used in the shaft hole forming step includes a tip having a conical shape having a vertex angle in a range of 70° to 120°, wherein the first die has an inner side wall that is separated from an outer periphery of the protrusion-including column portion of the forged workpiece with a gap therebetween, and a gap volume that is provided between the outer periphery of the protrusion-including column portion and the inner side wall has such a size that, during punching of the protrusion-including column portion of the forged workpiece using the first punch, a slug is not generated and the protrusion-including column portion expands outward when the first punch is pressed into the protrusion-including column portion from a punching start point to a predetermined dimension, and a slug is generated and discharged when the first punch is pressed into the protrusion-including column portion from the predetermined dimension to the punching end point, wherein the second die has substantially the same shape as the first die, and wherein the second punch includes a tip having a frusto-conical or conical shape having a vertex angle in a range of 70° to 120°, and the second punch has a maximum diameter that is larger than a maximum diameter of the first punch by 0.1 to 0.3 mm.

According to the present invention, there is further provided a method of manufacturing an automobile door hinge through a process including hot forging and punching, the automobile door hinge being made of steel and including a strip-shaped mounting portion and a protrusion-including engagement portion that is disposed in a portion bent away from the mounting portion and that has a cylindrical shape, the protrusion-including engagement portion having a shaft hole into which a hinge pin is to be inserted and a door stop protrusion on a distal side of the cylindrical shape, the method including:

a hot forging step of hot forging a round steel bar to form a strip-shaped mounting portion and a protrusion-including column portion that is disposed in a portion bent away from the mounting portion and that has a horizontal cross section having a circular or elliptical shape, the protrusion-including column portion having a door stop protrusion on a distal side of the circular or elliptical shape;

a shaft hole forming step of forming a shaft hole, into which a hinge pin is to be inserted, in the protrusion-including column portion formed in the hot forging step by using a first punch and a first die so that the shaft hole extends through an axial center of the protrusion-including column portion; and a shaft hole finishing step of punching the shaft hole formed in the shaft hole forming step by using a second punch and a second die from a side of the shaft hole on which a punching end point exists at which punching with the first punch has been finished, wherein, in the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies, wherein the lower die has a concave portion for receiving a protruding surface on a protruding side of a bent portion of the forged workpiece to be formed in the hot forging step so that the bent portion of the forged workpiece protrudes downward, wherein the upper die has a convex portion whose shape matches that of an opposite surface of the bent portion of the forged workpiece opposite to the protruding surface, wherein a height of the shaft hole formed in the shaft hole forming step in the protrusion-including column portion is 2.0 times a diameter of the shaft hole or larger, wherein the first punch used in the shaft hole forming step includes a tip having a conical shape having a vertex angle in a range of 70° to 120°, wherein the first die has an inner side wall that is separated from an outer periphery of the protrusion-including column portion of the forged workpiece with a gap therebetween, and a gap volume that is provided between the outer periphery of the protrusion-including column portion and the inner side wall has such a size that, during punching of the protrusion-including column portion of the forged workpiece using the first punch, a slug is not generated and the protrusion-including column portion expands outward when the first punch is pressed into the protrusion-including column portion from a punching start point to a predetermined dimension, and a slug is generated and discharged when the first punch is pressed into the protrusion-including column portion from the predetermined dimension to the punching end point, wherein the second die has substantially the same shape as the first die, and wherein the second punch includes a tip having a frusto-conical or conical shape having a vertex angle in a range of 70° to 120°, and the second punch has a maximum diameter that is larger than a maximum diameter of the first punch by 0.1 to 0.3 mm.

According to the present invention, there is further provided a method of manufacturing an automobile door hinge through a process including hot forging and punching, the automobile door hinge being made of steel and including a strip-shaped mounting portion and an engagement portion that is disposed in a portion bent away from the mounting portion and that has a cylindrical shape, the engagement portion having a shaft hole into which a hinge pin is to be inserted, the method including:

a hot forging step of hot forging a round steel bar to form a strip-shaped mounting portion and a column portion that is disposed in a portion bent away from the mounting portion and that has a horizontal cross section having a circular or elliptical shape;

a shaft hole forming step of forming a shaft hole, into which a hinge pin is to be inserted, in the column portion formed in the hot forging step by using a first punch and a first die so that the shaft hole extends through an axial center of the column portion; and a shaft hole finishing step of punching the shaft hole formed in the shaft hole forming step by using a second punch and a second die from a side of the shaft hole on which a punching end point exists at which punching with the first punch has been finished;

wherein, in the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies, wherein the lower die has a concave portion for receiving a protruding surface on a protruding side of a bent portion of the forged workpiece to be formed in the hot forging step so that the bent portion of the forged workpiece protrudes downward, wherein the upper die has a convex portion whose shape matches that of an opposite surface of the bent portion of the forged workpiece opposite to the protruding surface, wherein a height of the shaft hole formed in the shaft hole forming step in the column portion is 2.0 times a diameter of the shaft hole or larger, wherein the first punch used in the shaft hole forming step includes a tip having a conical shape having a vertex angle in a range of 70° to 120°, wherein the first die has an inner side wall that is separated from an outer periphery of the column portion of the forged workpiece with a gap therebetween, and a gap volume that is provided between the outer periphery of the column portion and the inner side wall has such a size that, during punching of the column portion of the forged workpiece using the first punch, a slug is not generated and the column portion expands outward when the first punch is pressed into the column portion from a punching start point to a predetermined dimension, and a slug is generated and discharged when the first punch is pressed into the column portion from the predetermined dimension to the punching end point, wherein the second die has substantially the same shape as the first die, and wherein the second punch includes a tip having a frusto-conical or conical shape having a vertex angle in a range of 70° to 120°, and the second punch has a maximum diameter that is larger than a maximum diameter of the first punch by 0.1 to 0.3 mm.

The method of manufacturing an automobile door hinge of the present invention may further include a trimming step of removing a burr of the forged workpiece formed in the hot forging step by using a trimming press, wherein the trimming step is performed after the hot forging step while the forged workpiece is hot.

According to the present invention, in the hot forging step, a round steel bar having a temperature in the range of 1200° C.±50° C. may be forged.

According to the present invention, the shaft hole forming step may be performed by cold working.

Advantageous Effects of Invention

The method of manufacturing an automobile door hinge according to the present invention includes a hot forging step of hot forging a round steel bar to form a strip-shaped mounting portion, a strip-shaped arm portion that is bent away from the mounting portion, and a column portion or a protrusion-including column portion that is disposed at an end of the arm portion and that has a horizontal cross section having a circular or elliptical shape; a shaft hole forming step of forming a shaft hole, into which a hinge pin is to be inserted, in the column portion or the protrusion-including column portion formed in the hot forging step by using a first punch and a first die so that the shaft hole extends through an axial center of the column portion or the protrusion-including column portion; and a shaft hole finishing step of punching the shaft hole formed in the shaft hole forming step by using a second punch and a second die from a side of the shaft hole on which a punching end point exists at which punching with the first punch has been finished. In the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies. The first punch used in the shaft hole forming step includes a tip having a conical shape having a vertex angle in a range of 70° to 120°. The first die has an inner side wall that is separated from an outer periphery of the column portion or the protrusion-including column portion of the forged workpiece with a gap therebetween; and a gap volume that is provided between the outer periphery of the column portion or the protrusion-including column portion and the inner side wall has such a size that, during punching of the column portion or the protrusion-including column portion of the forged workpiece using the first punch, a slug is not generated and the column portion or the protrusion-including column portion expands outward when the first punch is pressed into the column portion or the protrusion-including column portion from a punching start point to a predetermined dimension, and a slug is generated and discharged when the first punch is pressed into the column portion or the protrusion-including column portion from the predetermined dimension to the punching end point. Therefore, the method has advantageous effects that a shaft hole having a height that is twice the diameter thereof or larger can be formed by punching, and an automobile door hinge having sufficient strength can be manufactured at low cost through a process including hot forging and punching a round steel bar.

The method of manufacturing an automobile door hinge according to the present invention may include a hot forging step of hot forging a round steel bar to form a polygonal plate-shaped mounting portion, a strip-shaped arm portion that is bent away from the mounting portion and that has a dimension smaller than a height dimension of the mounting portion, and a column portion or a protrusion-including column portion that is disposed at an end of the arm portion and that has a horizontal cross section having a circular or elliptical shape; a shaft hole forming step of forming a shaft hole, into which a hinge pin is to be inserted, in the column portion or the protrusion-including column portion formed in the hot forging step by using a first punch and a first die so that the shaft hole extends through an axial center of the column portion or the protrusion-including column portion; and a shaft hole finishing step of punching the shaft hole formed in the shaft hole forming step by using a second punch and a second die from a side of the shaft hole on which a punching end point exists at which punching with the first punch has been finished. In the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies. The first punch used in the shaft hole forming step includes a tip having a conical shape having a vertex angle in a range of 70° to 120°. The first die has an inner side wall that is separated from an outer periphery of the column portion or the protrusion-including column portion of the forged workpiece with a gap therebetween; and a gap volume that is provided between the outer periphery of the column portion or the protrusion-including column portion and the inner side wall has such a size that, during punching of the column portion or the protrusion-including column portion of the forged workpiece formed in the hot forging step using the first punch, a slug is not generated and the column portion or the protrusion-including column portion expands outward when the first punch is pressed into the column portion or the protrusion-including column portion from a punching start point to a predetermined dimension, and a slug is generated and discharged when the first punch is pressed into the column portion or the protrusion-including column portion from the predetermined dimension to the punching end point. Therefore, the method has advantageous effects that a shaft hole having a height that is twice the diameter thereof or larger can be formed by punching, and an automobile door hinge having sufficient strength can be manufactured at low cost through a process including hot forging and punching a round steel bar.

The method of manufacturing an automobile door hinge according to the present invention may include a hot forging step of hot forging a round steel bar to form a strip-shaped mounting portion and a protrusion-including column portion or a column portion that is disposed in a portion bent away from the mounting portion and that has a horizontal cross section having a circular or elliptical shape; a shaft hole forming step of forming a shaft hole, into which a hinge pin is to be inserted, in the protrusion-including column portion or the column portion formed in the hot forging step by using a first punch and a first die so that the shaft hole extends through an axial center of the protrusion-including column portion or the column portion; and a shaft hole finishing step of punching the shaft hole formed in the shaft hole forming step by using a second punch and a second die from a side of the shaft hole on which a punching end point exists at which punching with the first punch has been finished. In the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies. The first punch used in the shaft hole forming step includes a tip having a conical shape having a vertex angle in a range of 70° to 120°. The first die has an inner side wall that is separated from an outer periphery of the protrusion-including column portion or the column portion of the forged workpiece with a gap therebetween; and a gap volume that is provided between the outer periphery of the protrusion-including column portion or the column portion and the inner side wall has such a size that, during punching of the protrusion-including column portion or the column portion of the forged workpiece using the first punch, a slug is not generated and the protrusion-including column portion or the column portion expands outward when the first punch is pressed into the protrusion-including column portion or the column portion from a punching start point to a predetermined dimension, and a slug is generated and discharged when the first punch is pressed into the protrusion-including column portion or the column portion from the predetermined dimension to the punching end point. Therefore, the method has advantageous effects that a shaft hole having a height that is twice the diameter thereof or larger can be formed by punching, and an automobile door hinge having sufficient strength can be manufactured at low cost through a process including hot forging and punching a round steel bar.

The method of manufacturing an automobile door hinge according to the present invention may further include a trimming step of removing a burr of the forged workpiece formed in the hot forging step by using a trimming press, and the trimming step is performed after the hot forging step while the forged workpiece is hot. Therefore, the method further has advantageous effects that press trimming for which precision is not required can be performed easily, and the size a processing machine can be reduced.

In the method of manufacturing an automobile door hinge according to the present invention, a round steel bar having a temperature in the range of 1200° C.±50° C. may be forged in the hot forging step. Therefore, the method further has an advantageous effect that the quality of the forged workpiece formed in the hot forging step can be controlled to be in a certain range.

In the method of manufacturing an automobile door hinge according to the present invention, the shaft hole forming step may be performed by cold working. Therefore, the method further has an advantageous effect that the precision of the shaft hole formed in the shaft hole forming step can be increased.

DESCRIPTION OF EMBODIMENTS

Hereinafter, embodiments of the present invention will be described in detail with reference to the attached drawings.

Referring FIGS. 1 to 15, a method of manufacturing an automobile door hinge according to a first embodiment of the present invention will be described.

First, the outline of the method of manufacturing an automobile door hinge according to the first embodiment of the present invention will be described with reference to FIG. 1, which is a block diagram.

The manufacturing method according to the first embodiment includes a cutting step 20, a heating step 25, a hot forging step 30, a trimming step 40, a cooling step 45, a shaft hole forming step 50, a shaft hole finishing step 60, and a hole forming step 70.

Figure 2:
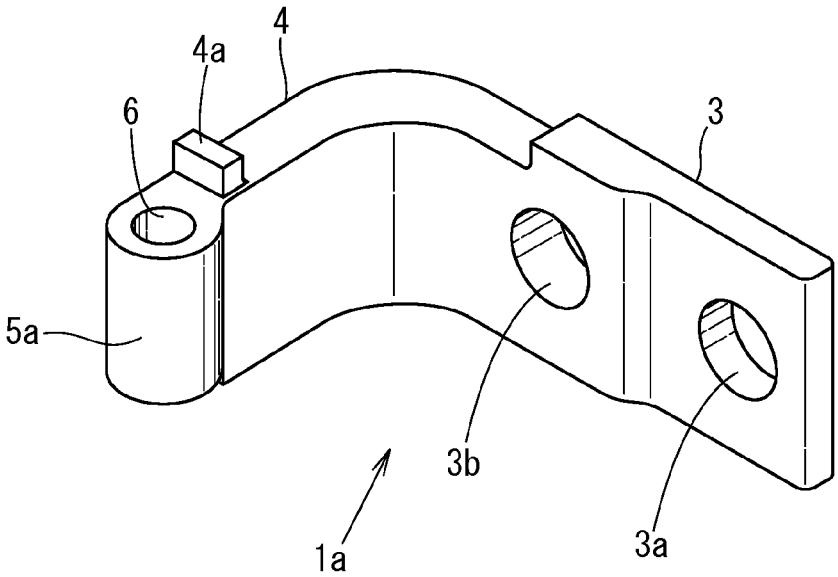
FIG. 2 is a perspective view of a body-side door hinge according to the first embodiment of the present invention.

FIG. 2 illustrates a body-side door hinge 1*a*, which is to be attached to an automobile body, made by the manufacturing method according to the first embodiment. As illustrated in FIG. 2, the body-side door hinge 1*a* includes a strip-shaped mounting portion 3, a strip-shaped arm portion 4 that is bent away from the mounting portion 3, and an engagement portion 5*a* that is formed at an end of the arm portion 4 and that has a cylindrical shape. The engagement portion 5*a* has a shaft hole 6 into which a hinge pin is to be inserted. A stopper

4*a* is formed on the arm portion 4, and mounting holes 3*a* and 3*b* are formed in the mounting portion 3.

Referring to FIG. 1 and FIGS. 3 to 15, the steps 20 to 70 for manufacturing the body-side door hinge 1*a* will be described sequentially.

Figure 3:
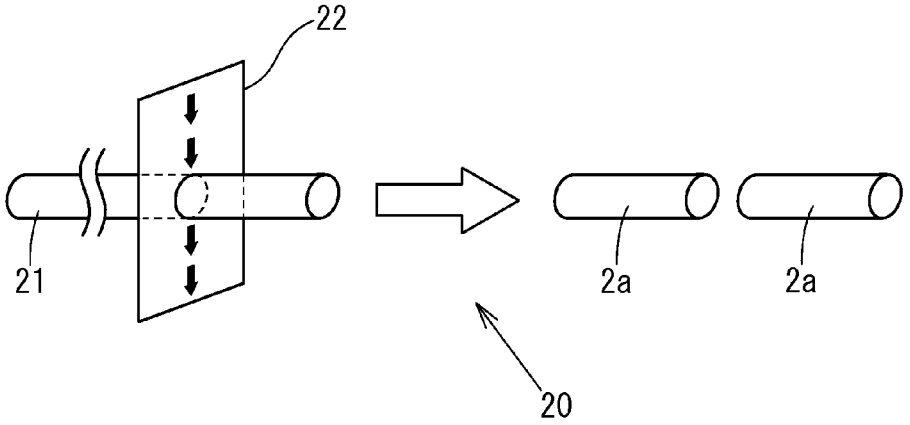
FIG. 3 illustrates a cutting step according to the first embodiment of the present invention.

In the cutting step 20 illustrated in FIG. 3, a scale-covered round steel bar 21, which is made of S45C steel and which has a diameter of 23 mm and a length of 5500 mm, is cut to round steel bar materials 2*a* each having a diameter of 23 mm and a length of 125 mm by using a cutting machine 22.

Next, in the heating step 25 (see FIG. 1), although not illustrated, a conveyer conveys each of the materials 2*a*, which has been formed in the cutting step 20, through a heating furnace so that the material 2*a* is heated to a temperature in the range of 1200° C.±50° C., and then the material 2*a* is conveyed out of the heating furnace.

The heating furnace uses electric power or fuel gas as a heat source. The electric power or a gas burner is adjusted so that the material 2*a* has a temperature in the range of 1200° C.±50° C. when the material 2*a* is conveyed out of the heating furnace.

The conveyer conveys the material 2*a* through the heating furnace in six seconds, which match a production takt time of the hot forging step 30 to be performed next.

Figure 4:
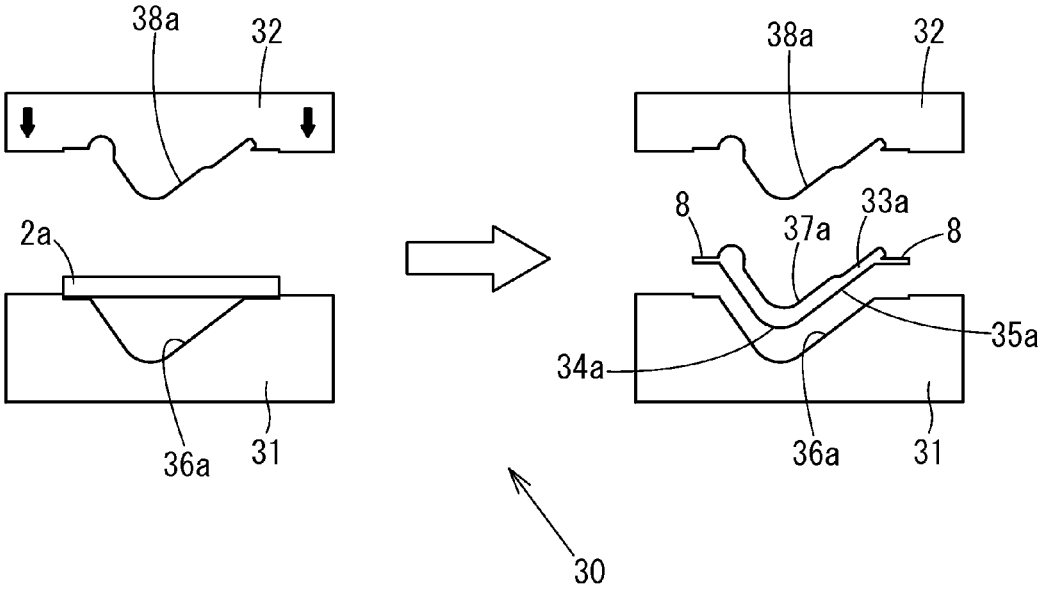
FIG. 4 illustrates a hot forging step according to the first embodiment of the present invention.

The material 2*a*, which has been heated to 1200° C.±50° C. in the heating furnace, is hot forged in the hot forging step 30 illustrated in FIG. 4.

In the hot forging step 30, hot forging is performed by using an air stamp hammer (not shown), a lower die 31, and an upper die 32. The lower and upper dies 31 and 32 are made of a hot work die steel that has high hardness and high corrosion resistance (such as SKD61 steel).

Before starting hot forging, the lower die 31 and the upper die 32 are heated to about 150° C. Then, the round steel bar material 2*a*, which has been heated to 1200° C.±50° C. in the heating step 25, is placed on the lower die 31. The upper die 32 is dropped onto the material 2*a* a plurality of times (for example, three times), and thereby a forged workpiece 33*a* having a predetermined shape is formed with the dies 31 and 32.

The lower die 31 has a concave portion 36*a* for receiving a protruding surface 35*a* on a protruding side of a bent portion 34*a* of the forged workpiece 33*a* formed in the hot forging step 30 so that the bent portion 34*a* of the forged workpiece 33*a* protrudes downward.

The upper die 32 has a convex portion 38*a* whose shape matches that of an opposite surface 37*a* of the bent portion 34*a* of the forged workpiece 33*a* opposite to the protruding surface.

Figure 5:
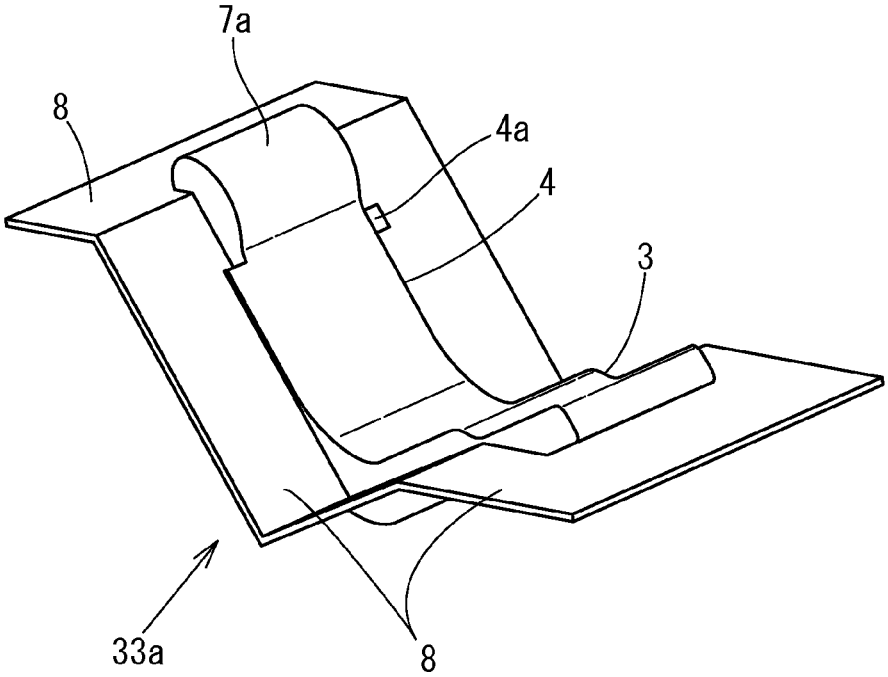
FIG. 5 is a perspective view of a forged workpiece formed by the hot forging step according to the first embodiment of the present invention.

As illustrated in FIG. 5, the forged workpiece 33*a* includes a strip-shaped mounting portion 3, a strip-shaped arm portion 4 that is bent away from the mounting portion 3, a column portion 7*a* that is disposed at an end of the arm portion 4 and that has a horizontal cross section having a circular shape, a stopper 4*a* that is formed on the arm portion 4, and a burr 8 that is formed outward from these members.

The burr 8 of the forged workpiece 33*a* is generated in a gap between mating faces the lower die 31 and the upper die 32.

The sizes of the lower die 31 and the upper die 32 are determined with consideration of thermal expansion of the forged workpiece 33*a* during hot forging and thermal contraction during use at room temperature.

That is, the lower die 31 and the upper die 32 are manufactured so as to have dimensions that are larger than the design values for use at room temperature with consideration of the coefficients of thermal expansion and the temperatures (for example, 200° C.) of the lower and upper dies 31 and 32 during hot forging and the coefficient of thermal expansion and the temperature (for example, 1200° C.) of the forged workpiece 33*a* during hot forging.

Next, the trimming step 40 for trimming and removing the burr 8 of the forged workpiece 33*a*, which has been formed in the hot forging step 30, is performed.

Figure 6:
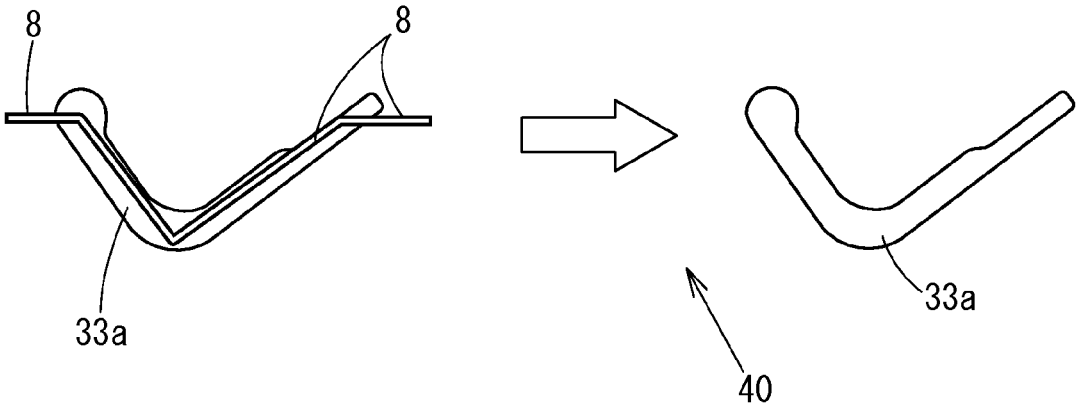
FIG. 6 illustrates a trimming step according to the first embodiment of the present invention.

In the trimming step 40 illustrated in FIG. 6, the burr 8 of the forged workpiece 33*a* is punched and removed by using a trimming press (not shown) while the forged workpiece 33*a* is hot after the hot forging step 30.

The trimming step 40 is performed while the forged workpiece 33*a* is hot, because dimensional accuracy is not required when removing the burr 8 of the forged workpiece 33*a*. By doing so, a trimming press having low capacity can be used.

In the cooling step 45 (see FIG. 1), the forged workpiece 33*a*, which is hot after the trimming step 40, is naturally cooled to room temperature for several hours in the atmosphere.

Figure 7:
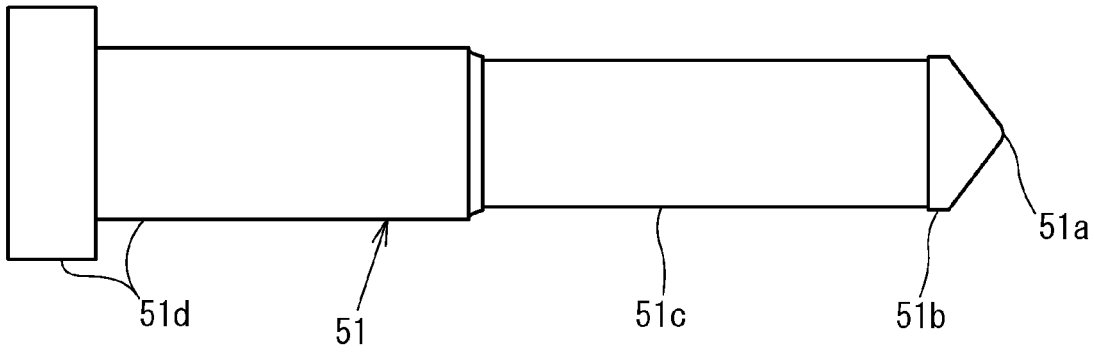
FIG. 7 is a front view of a first punch according to the first embodiment of the present invention.

Next, referring to FIGS. 7 to 10, the shaft hole forming step 50 will be described. FIG. 7 illustrates a first punch, FIG. 8 is a plan view of a first die, FIG. 9 is an enlarged plan view of a column portion of a forged workpiece and the first die, and FIG. 10 is a sectional view of upper and lower die sets.

In the shaft hole forming step 50, the shaft hole 6, into which a hinge pin is to be inserted, is formed in the column portion 7*a* of the forged workpiece 33*a* after the cooling step 45 by using a first punch 51 and a first die 52*a*, so that the shaft hole 6 extends through the axial center of the column portion 7*a*.

The first punch 51, which is illustrated in FIG. 7, includes a tip, a shaft portion 51*c*, and a shank 51*d*. The tip includes a rounded end portion 51*a*, a conical portion, and a cylindrical portion 51*b*. The radius of the rounded end portion 51*a* is 1 mm, and the vertex angle of the conical portion is 90°. The maximum diameter of the conical portion and the diameter of the cylindrical portion 51*b* are 8.6 mm. The length of the cylindrical portion 51*b* is 1 mm. The diameter of the shaft portion 51*c* is smaller than that of the cylindrical portion 51*b* by 0.2 mm.

Figure 8:
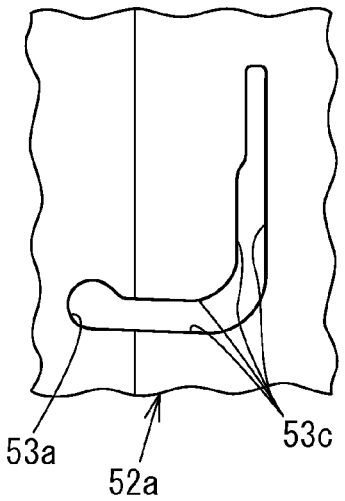
FIG. 8 is a plan view of a first die according to the first embodiment of the present invention.
Figure 9:
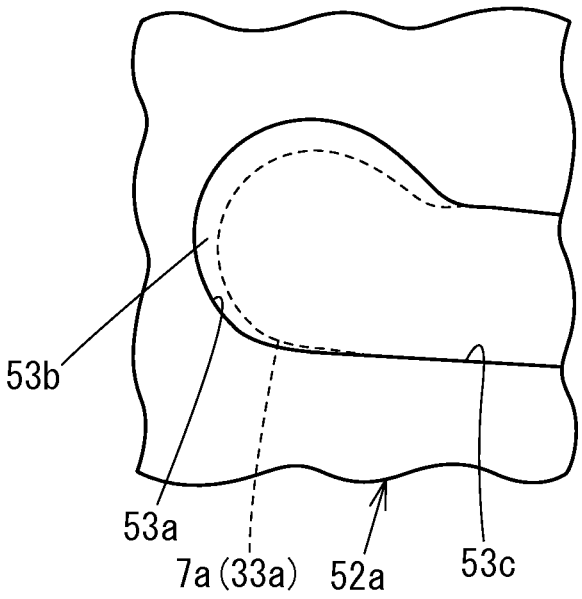
FIG. 9 is an enlarged partial plan view illustrating a column portion and the first die according to the first embodiment of the present invention.
Figure 10:
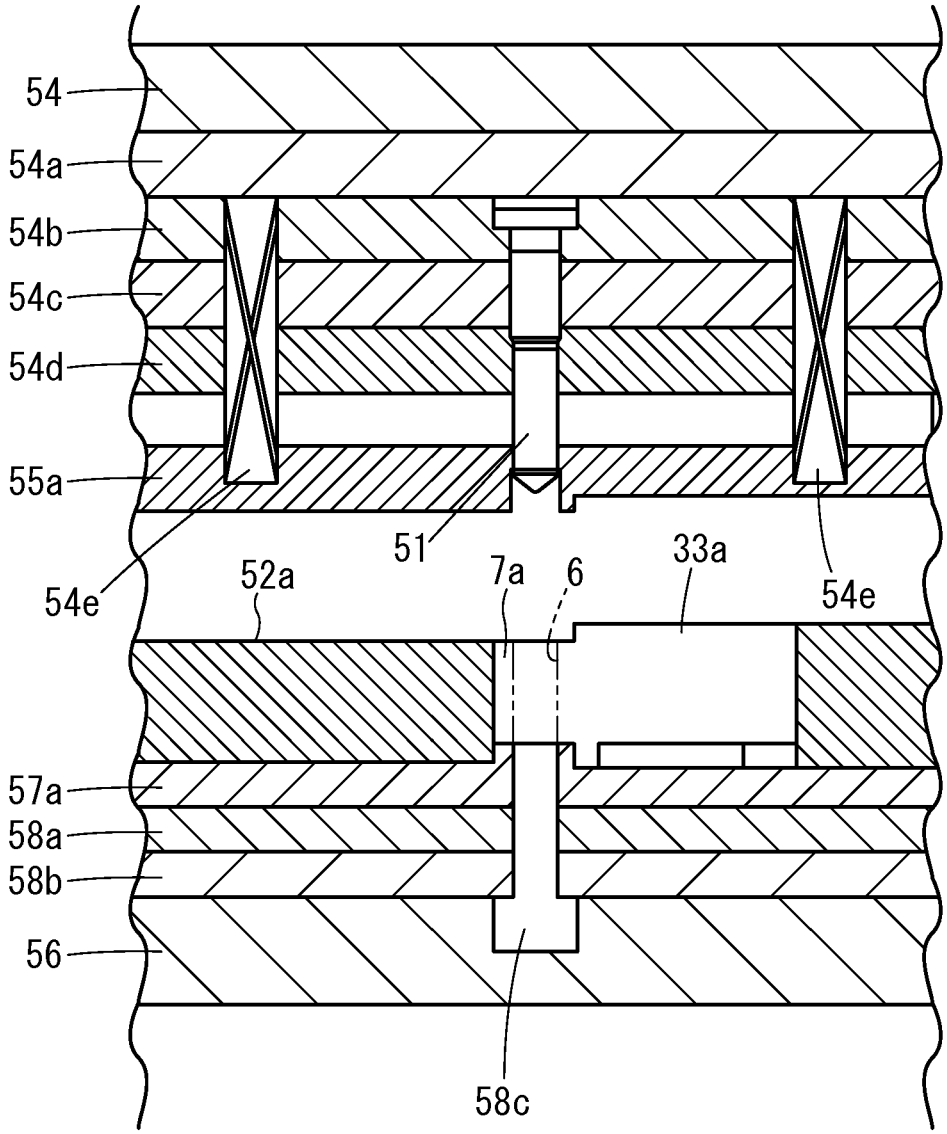
FIG. 10 is a sectional view of upper and lower die sets used in a shaft hole forming step according to the first embodiment of the present invention.

As illustrated in FIG. 9, the first die 52*a* illustrated FIG. 8 has an inner side wall 53*a* that is separated from an outer periphery of the column portion 7*a* (shown by a dotted line) of the forged workpiece 33*a* with a gap therebetween. A gap volume 53*b* that is provided between the outer periphery of the column portion 7*a* and the inner side wall 53*a* has such a size that, during punching of the column portion 7*a* of the forged workpiece 33*a* using the first punch 51, a slug is not generated and the column portion 7*a* expands outward when the first punch 51 is pressed into the column portion 7*a* from a punching start point to a position at ⅘ of the length of the column portion 7*a*, and a slug is generated and discharged when the first punch 51 is pressed into the column portion 7*a* from the position at ⅘ of the length of the column portion 7*a* to a punching end point.

An inner side wall 53*c* of the first die 52*a*, which does not face the column portion 7*a*, has such a shape that the inner side wall 53*c* comes into contact with the outer peripheries of the mounting portion 3 and the arm portion 4 of the forged workpiece 33*a* without a gap therebetween. The column portion 7*a* of the forged workpiece 33*a* is positioned with respect to the inner side wall 53*c*.

By using the first punch 51, the first die 52*a*, and a transfer press having a capacity of 500 ton, the shaft hole 6 is formed in the axial center of the column portion 7*a*.

As illustrated in FIG. 10, the transfer press used in the shaft hole forming step has an upper die set 54, which moves up and down, and a lower die set 56, which is fixed to the transfer press. The first punch 51 is attached to the upper die set 54 using a punch plate 54*a*; punch holders 54*b*, 54*c*, and 54*d*; springs 54*e*; a stripper 55*a*; and the like. The first die 52*a* is attached to the lower die set 56 using a die holder 57*a*, die plates 58*a* and 58*b*, and the like.

Then, the forged workpiece 33*a* is inserted into the first die 52*a*. The upper die set 54 is lowered so that the stripper 55*a* of the upper die set 54 contacts the first die 52*a*. The forged workpiece 33*a*, excluding a portion in which the shaft hole 6 is to be formed, is vertically fixed between the stripper 55*a* and the die holder 57*a* using the springs 54*e*. Then, the shaft hole 6 is formed by lowering the first punch 51. When the first punch 51 is pressed into the column portion 7*a* from a punching start point to a position at ⅘ of the length of the column portion 7*a*, a slug is not generated and the column portion 7*a* expands outward so as to fill the gap volume 53*b* in the first die 52*a*. When the first punch 51 is pressed further into the column portion 7*a* from the position at ⅘ of the length of the column portion 7*a* to the punching end point, a slug is generated and discharged to the outside through a slug discharge hole 58*c*.

Next, the upper die set 54 is lifted to the initial position, a hydraulic device (not shown) pushes up the forged workpiece 33*a*, in which the shaft hole 6 has been formed, so as to remove the forged workpiece 33*a* from the first die 52*a*, thereby finishing the shaft hole forming step 50.

Thus, in the shaft hole forming step 50, the column portion 7*a* of the forged workpiece 33*a* is formed into the engagement portion 5*a*, which has a cylindrical shape having an inside diameter of 8.8 mm and a height of 24 mm.

After the shaft hole forming step 50, the forged workpiece 33*a* is turned upside down, and the shaft hole 6, which has been formed in the engagement portion 5*a* of the forged workpiece 33*a*, is finished in the shaft hole finishing step 60 by using the transfer press.

Figure 11:
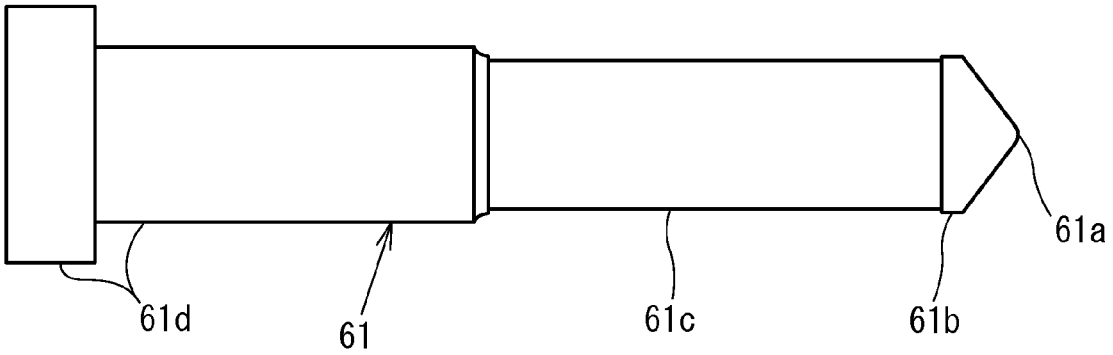
FIG. 11 is a front view of a second punch according to the first embodiment of the present invention.
Figure 12:
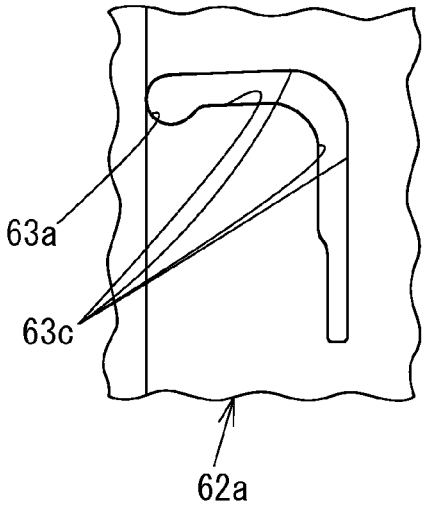
FIG. 12 is a plan view of a second die according to the first embodiment of the present invention.
Figure 13:
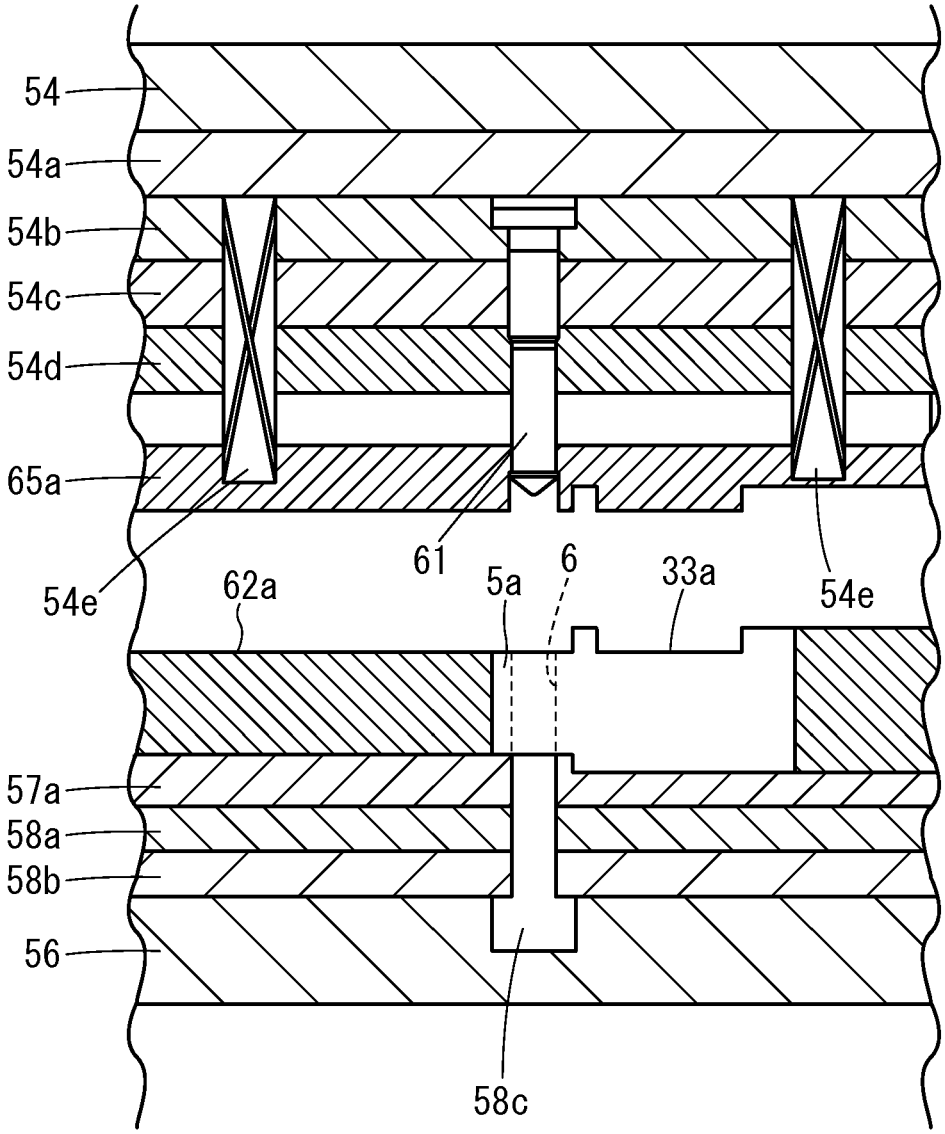
FIG. 13 is a sectional view of upper and lower die sets used in a shaft hole finishing step according to the first embodiment of the present invention.

As illustrated in FIGS. 11 to 13, in the shaft hole finishing step 60, the shaft hole 6, which has been formed in the engagement portion 5*a* of the forged workpiece 33*a* in the shaft hole forming step 50, is finished with high precision by using a second punch 61 and a second die 62*a*.

The second punch 61, which is illustrated in FIG. 11, includes a tip, a shaft portion 61*c*, and a shank 61*d*. The tip includes a rounded end portion 61*a*, a conical portion, and a cylindrical portion 61*b*. The radius of the rounded end portion 61*a* is 1 mm, and the vertex angle of the conical portion is 90°. The maximum diameter of the conical portion and the diameter of the cylindrical portion 61*b* are 8.8 mm. The length of the cylindrical portion 61*b* is 1 mm. The diameter of the shaft portion 61*c* is smaller than that of the cylindrical portion 61*b* by 0.2 mm. The second punch 61 differs from the first punch 51 in that the maximum diameter of the conical portion, the diameter of the cylindrical portion 61*b*, and the diameter of the shaft portion 61*c* are respectively larger than the maximum diameter of the conical portion, the diameter of the cylindrical portion 51*b*, and the diameter of the shaft portion 51*c* of the first punch 51 by 0.2 mm, so that finishing can be performed.

The second die 62*a* illustrated in FIG. 12 has an inner side wall having a shape the same as that of the first die 52*a*. The inner side wall includes an inner side wall 63*a*, whose shape matches that of the expanded outer periphery of the engagement portion 5*a* of the forged workpiece 33*a*, and an inner side wall 63*c*, whose shape matches that of the outer peripheries of the mounting portion 3 and the arm portion 4. The outer periphery of the forged workpiece 33*a* comes into contact with the inner side walls 63*a* and 63*c* without a gap therebetween.

As illustrated in FIGS. 8 and 12, because the forged workpiece 33*a* is inserted into the first die 52*a* and the second die 62*a* in vertically opposite orientations, the first die 52*a* and the second die 62*a* have shapes that are vertically symmetric to each other.

Also in the shaft hole finishing step 60, the transfer press used in the shaft hole forming step 50 is used. As illustrated in FIG. 13, the second punch 61 is attached to the upper die set 54, and the second die 62*a* is fixed to the lower die set 56.

Figure 14:
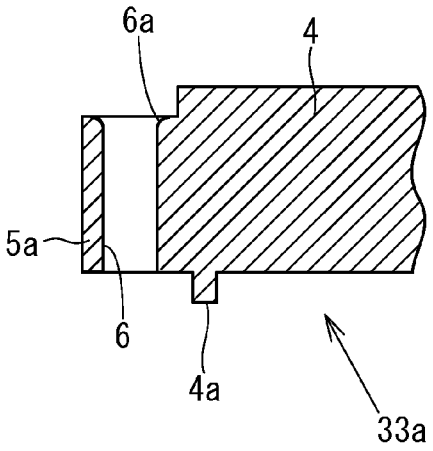
FIG. 14 is a sectional view illustrating a shear droop portion according to the first embodiment of the present invention.

The maximum diameter of the second punch 61 used in the shaft hole finishing step 60 is larger than the maximum diameter of the first punch 51 used in the shaft hole forming step 50 by 0.2 mm. The forged workpiece 33*a* cannot expand vertically due to the presence of the stripper 65*a* and the die holder 57*a* and cannot expand outward due to the presence of the second die 62*a*. Therefore, the diameter of the shaft hole 6 is increased by 0.2 mm in the shaft hole finishing step 60. At this time, excess metal does not become a slug but serves to compensate for a shear droop portion 6*a*, which is formed adjacent to a punching start point of the shaft hole forming step 50 as illustrated in FIG. 14, or is absorbed in a small gap between the engagement portion 5*a* and the inner side wall 63*a* of the second die 62*a*.

By using the second punch 61, the second die 62*a*, and a transfer press having a capacity of 500 ton, the shaft hole 6 having a diameter of about 8.8 mm, which has been formed in the engagement portion 5*a*, is finished so as to have a diameter of 9.0 mm.

Referring to FIG. 13, the shaft hole finishing step will be described using the same numerals for the components the same as those of the shaft hole forming step 50. The transfer press has an upper die set 54, which moves up and down, and a lower die set 56, which is fixed to the transfer press. The second punch 61 is attached to the upper die set 54 using the punch plate 54*a*; the punch holders 54*b*, 54*c*, and 54*d*; a stripper 65*a*; the springs 54*e*; and the like. The second die 62*a* is attached to the lower die set 56 using the die holder 57*a*, the die plates 58*a* and 58*b*, and the like.

Then, the forged workpiece 33*a* is turned upside down and inserted into the second die 62*a*. The upper die set 54 is lowered so that the stripper 65*a* of the upper die set 54 contacts the second die 62*a*. The forged workpiece 33*a*, excluding a portion in which the shaft hole 6 is to be formed, is vertically fixed between the stripper 65*a* and the die holder 57*a* using the springs 54*e*. Then, the shaft hole 6 is finished by lowering the second punch 61.

Next, the upper die set 54 is lifted to the initial position, a hydraulic device (not shown) pushes up the forged workpiece 33*a* having the finished shaft hole 6, so as to remove the forged workpiece 33*a* from the second die 62*a*, thereby finishing the shaft hole finishing step 60.

Figure 15:
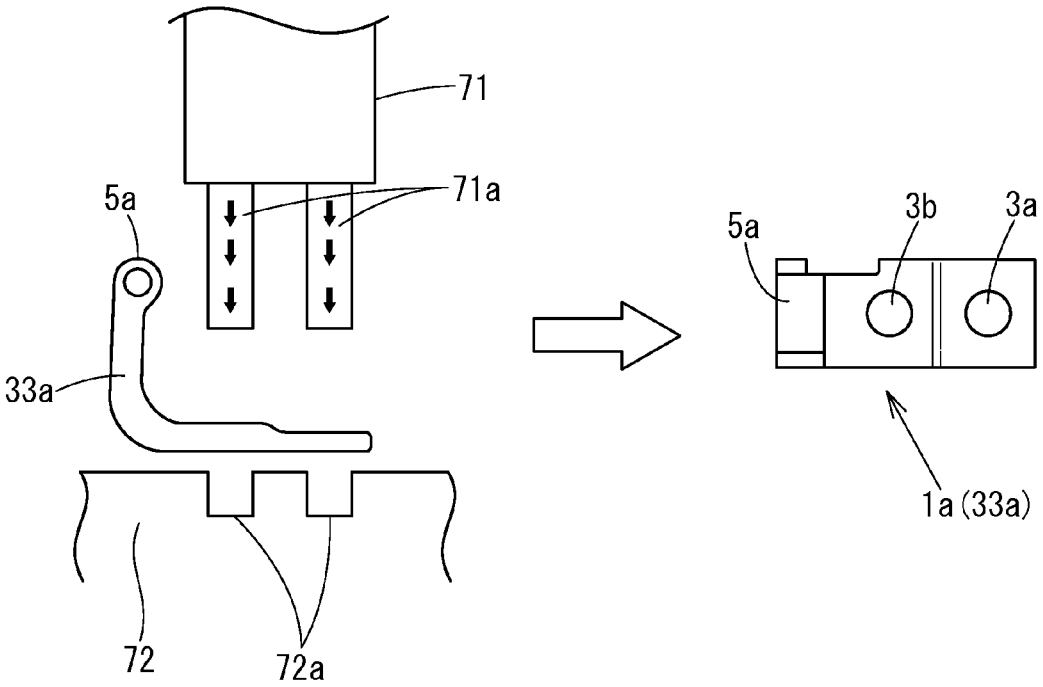
FIG. 15 illustrates a hole forming step according to the first embodiment of the present invention.

After the shaft hole finishing step 60, the transfer press transfers the forged workpiece 33*a* to the hole forming step 70 illustrated in FIG. 15.

In the hole forming step 70, two mounting holes 3*a* and 3*b*, each having a diameter of 14 mm, are formed in the mounting portion 3 of the forged workpiece 33*a*. The mounting holes 3*a* and 3*b* are used to attach the door hinge to an automobile body. The mounting hole 3*a* is formed in a thin end portion of the mounting portion 3, and the mounting hole 3*b* is formed in a middle portion of the mounting portion 3.

In the hole forming step 70, a hole cutting punch 71 having two cylindrical portions 71*a* each having an outside diameter of 14 mm, and a hole die 72 having two holes 72*a* each having a diameter of 14 mm are used.

After the hole forming step 70, the process of manufacturing the body-side door hinge 1*a* according to the first embodiment is finished.

Next, referring to FIGS. 16 to 20, a method of manufacturing an automobile door hinge according to a second embodiment of the present invention will be described.

The method of manufacturing an automobile door hinge according to the second embodiment differs from that of the first embodiment in a part of the structure of the body-side door hinge 1*a*.

To be specific, the structure of a body-side door hinge according to the second embodiment differs from that of the first embodiment in the following respect. That is, in the body-side door hinge according to the second embodiment, the mounting portion, the arm portion, and the engagement portion have the same height; the arm portion does not have a stopper; and the engagement portion is a protrusion-including engagement portion having a door stop protrusion on a distal side the cylindrical shape of the engagement portion.

Figure 16:
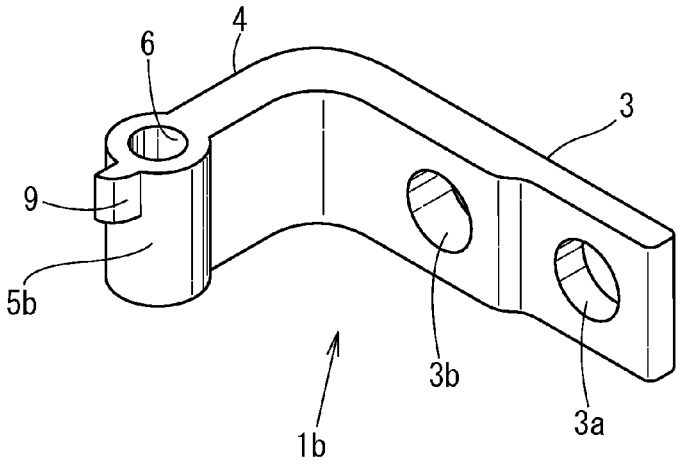
FIG. 16 is a perspective view of a body-side door hinge according to a second embodiment of the present invention.

FIG. 16 illustrates a body-side door hinge 1*b*, which is to be attached to an automobile body, made by the manufacturing method according to the second embodiment. As illustrated in FIG. 16, the body-side door hinge 1*b* includes a strip-shaped mounting portion 3, a strip-shaped arm portion 4 that is bent away from the mounting portion 3, and a protrusion-including engagement portion 5*b* that is disposed at an end of the arm portion 4 and that has a cylindrical shape. The protrusion-including engagement portion 5*b* has a shaft hole 6, into which a hinge pin is to be inserted, and a door stop protrusion 9 on a distal side of the cylindrical shape. Mounting holes 3*a* and 3*b* are formed in the mounting portion 3.

The mounting portion 3, the arm portion 4, and the protrusion-including engagement portion 5*b* of the body-side door hinge 1*b* have the same height. The door stop protrusion 9 is formed on an upper part of the protrusion-including engagement portion 5*b* having a length that is ⅓ of the height of the protrusion-including engagement portion 5*b*.

Hereinafter, the steps the same as those of the first embodiment will be denoted by the same numerals, and such steps will not be described or will be described simply.

Figure 1:
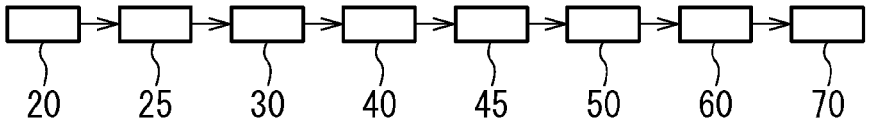
FIG. 1 is a block diagram according to a first embodiment of the present invention.

Description of the outline of the manufacturing method according to the second embodiment will be omitted, because the outline is the same as that of the first embodiment, which is illustrated in FIG. 1. In the following description, the steps and the numerals used in the first embodiment will be used.

Description of a cutting step 20 and a heating step 25 of the second embodiment will be omitted, because they are the same as those of the first embodiment.

Figure 17:
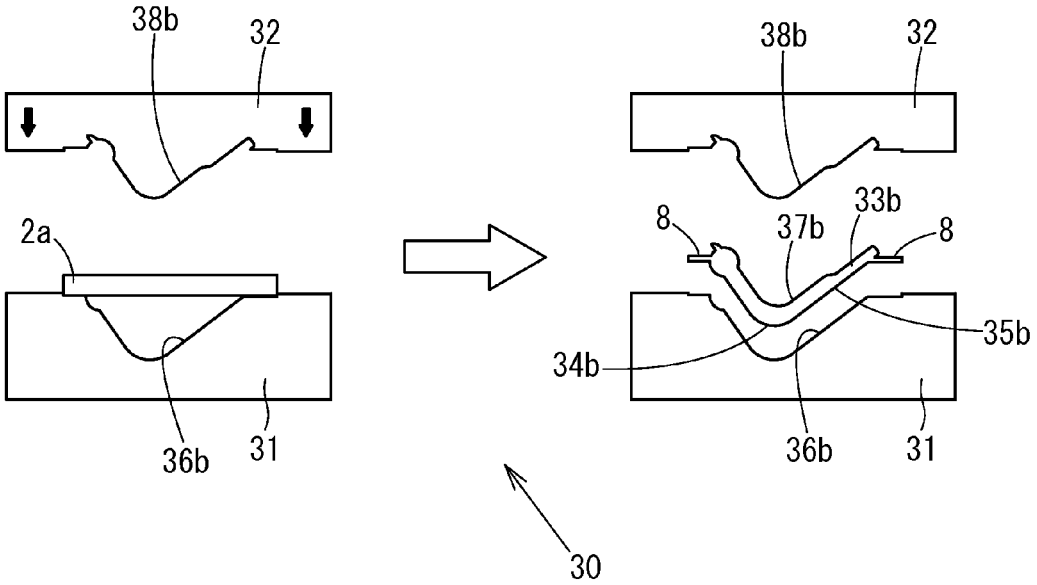
FIG. 17 illustrates a hot forging step according to the second embodiment of the present invention.

In a hot forging step 30 of the second embodiment, the structure of a forged workpiece 33*b* is different from that of the forged workpiece 33*a* of the first embodiment. Therefore, as illustrated in FIG. 17, the shape of a concave portion 36*b* in the lower die 31 is formed so as to receive a protruding surface 35*b* on a protruding side of a bent portion 34*b* of the forged workpiece 33*b*, and the shape of a convex portion 38*b* of the upper die 32 is formed so as to match the shape of an opposite surface 37*b* of the forged workpiece 33*b* opposite to the protruding surface 35*b*.

Description of the method of hot forging will be omitted, because it is the same as that of the first embodiment.

Description of a trimming step 40 and a cooling step 45 of the second embodiment will be omitted, because they are the same as those of the first embodiment.

In a shaft hole forming step 50 of the second embodiment, the shape of the forged workpiece 33*b* is different from that of the first embodiment. Therefore, a first die 52*b* is formed so as to have a shape illustrated in FIG. 18, and part of the structure of upper and lower die sets is changed as illustrated in FIG. 19.

Figure 18:
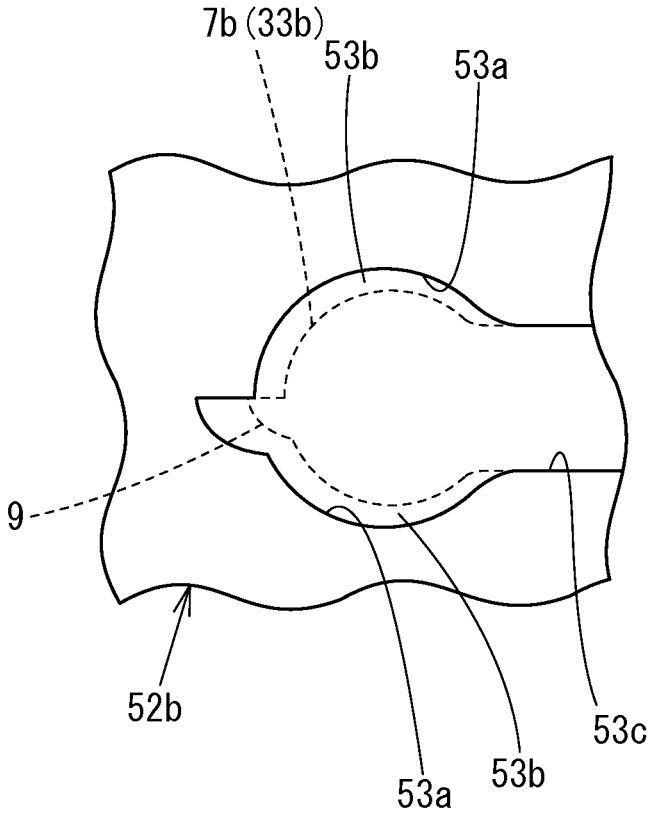
FIG. 18 is an enlarged partial plan view illustrating a protrusion-including column portion and a first die according to the second embodiment of the present invention.
Figure 19:
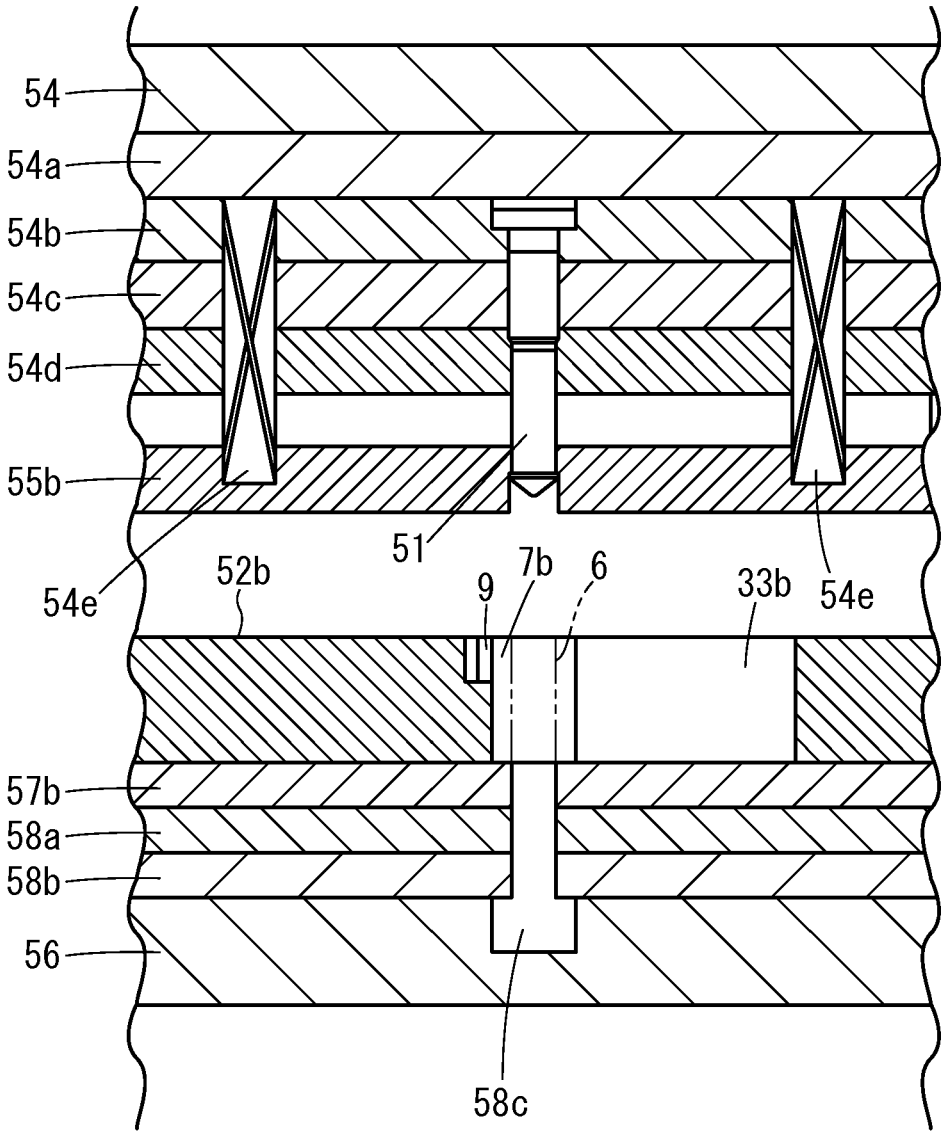
FIG. 19 is a sectional view of upper and lower die sets used in a shaft hole forming step according to the second embodiment of the present invention.

As illustrated in FIG. 18, the first die 52*b* has an inner side wall 53*a* that is separated from the outer periphery of a protrusion-including column portion 7*b* (shown by a dotted line) of the forged workpiece 33*b* with a gap therebetween. A gap volume 53*b* that is provided between the outer periphery of the protrusion-including column portion 7*b* and the inner side wall 53*a* has such a size that, during punching of the protrusion-including column portion 7*b* of the forged workpiece 33*b* using the first punch 51, which is the same as that of the first embodiment, a slug is not generated and the protrusion-including column portion 7*b* expands outward when the first punch 51 is pressed into the protrusion-including column portion 7*b* from a punching start point to a position at ⅘ of the length of the protrusion-including column portion 7*b*, and a slug is generated and discharged when the first punch 51 is pressed into the protrusion-including column portion 7*b* from the position at ⅘ of the length of the protrusion-including column portion 7*b* to a punching end point.

An inner side wall 53*c* of the first die 52*b*, which does not face the protrusion-including column portion 7*b*, has such a shape that the inner side wall 53*c* comes into contact with the outer peripheries of the mounting portion 3 and the arm portion 4 of the forged workpiece 33*b* without a gap therebetween. The protrusion-including column portion 7*b* of the forged workpiece 33*b* is positioned with respect to the inner side wall 53*c*.

By using the first punch 51, the first die 52*b*, and a transfer press having a capacity of 500 ton, the shaft hole 6 is formed in the axial center of the protrusion-including column portion 7*b*.

As illustrated in FIG. 19, the transfer press used in the shaft hole forming step has an upper die set 54, which moves up and down, and a lower die set 56, which is fixed to the transfer press. The first punch 51 is attached to the upper die set 54 using a punch plate 54*a*; punch holders 54*b*, 54*c*, and 54*d*; springs 54*e*; a stripper 55*b*; and the like. The first die 52*b* is attached to the lower die set 56 using a die holder 57*b*, die plates 58*a* and 58*b*, and the like.

Then, the forged workpiece 33*b* is inserted into the first die 52*b*. The upper die set 54 is lowered so that the stripper 55*b* of the upper die set 54 contacts the first die 52*b*. The forged workpiece 33*b*, excluding a portion in which the shaft hole 6 is to be formed, is vertically fixed between the stripper 55*b* and the die holder 57*b* using the springs 54*e*. Then, the shaft hole 6 is formed by lowering the first punch 51. When the first punch 51 is pressed into the protrusion-including column portion 7*b* from a punching start point to a position at ⅘ of the length of the protrusion-including column portion 7*b*, a slug is not generated and the protrusion-including column portion 7*b* expands outward so as to fill the gap volume 53*b* in the first die 52*b*. When the first punch 51 is pressed further into the protrusion-including column portion 7*b* from the position at ⅘ of the length of the protrusion-including column portion 7*b* to the punching end point, a slug is generated and discharged to the outside through a slug discharge hole 58*c*.

Next, the upper die set 54 is lifted to the initial position, a hydraulic device (not shown) pushes up the forged workpiece 33*b*, in which the shaft hole 6 has been formed, so as to remove the forged workpiece 33*b* from the first die 52*b*, thereby finishing the shaft hole forming step 50.

Thus, in the shaft hole forming step 50, the protrusion-including column portion 7*b* of the forged workpiece 33*b* is formed into the protrusion-including engagement portion 5*b*, which has a cylindrical shape having an inside diameter of 8.8 mm and a height of 24 mm.

After the shaft hole forming step 50, the forged workpiece 33*b* is turned upside down, and the shaft hole 6, which has been formed in the protrusion-including engagement portion 5*b* of the forged workpiece 33*b*, is finished in a shaft hole finishing step 60 by using the transfer press.

In the shaft hole finishing step 60, the shaft hole 6, which has been formed in the protrusion-including engagement portion 5*b* of the forged workpiece 33*b* in the shaft hole forming step 50, is finished with high precision by using a second die 62*b* and the second punch 61, which is the same as that of the first embodiment.

The second die 62*b* has an inner side wall having a shape the same as that of the first die 52*b*, excluding a portion of the inner side wall of the second die 62*b* that is located below the protrusion 9 of the forged workpiece 33*b* in the first die 52*b*.

Because the forged workpiece 33*b* is inserted into the first die 52*b* and the second die 62*b* in vertically opposite orientations, the first die 52*b* and the second die 62*b* have shapes that are vertically symmetric to each other.

Figure 20:
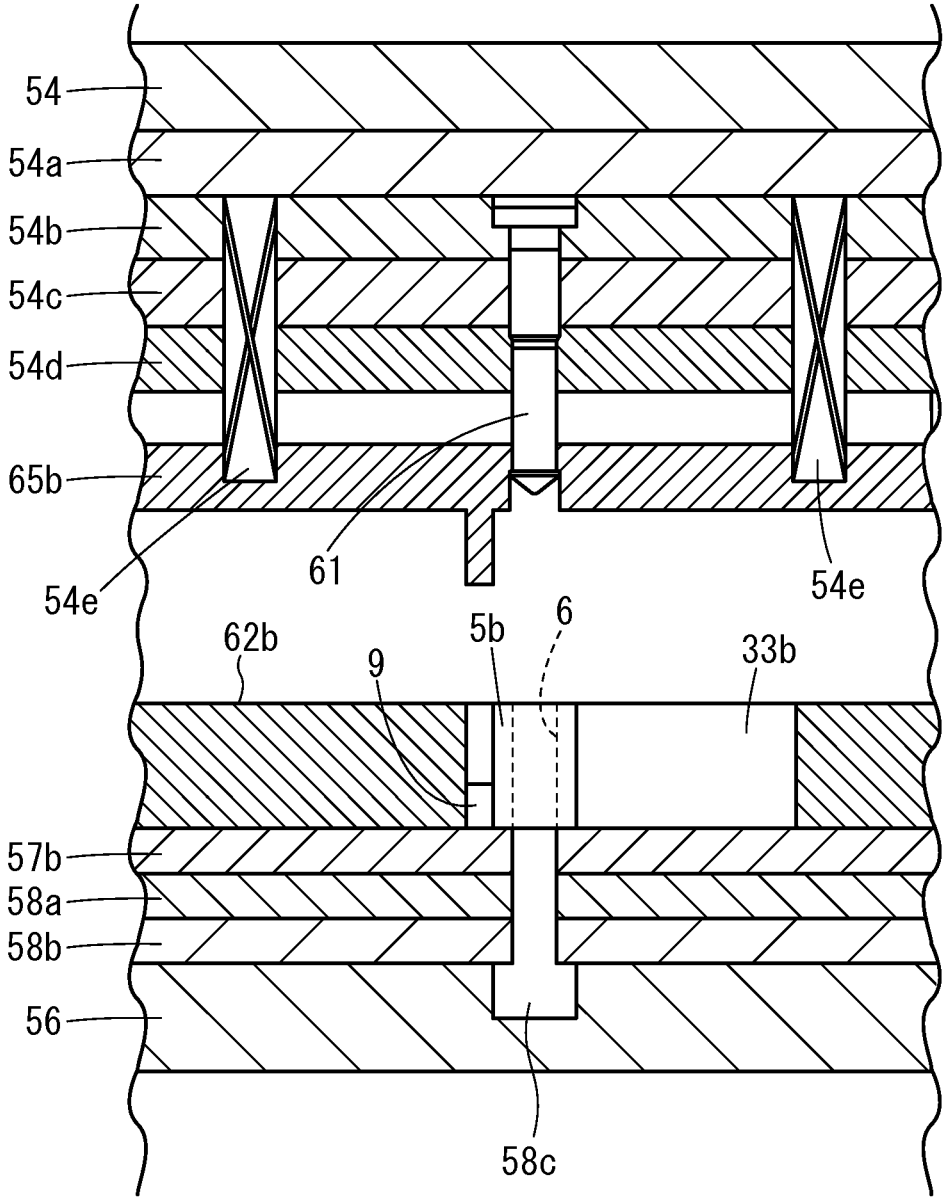
FIG. 20 is a sectional view of upper and lower die sets used in a shaft hole finishing step according to the second embodiment of the present invention.

Also in the shaft hole finishing step 60, the transfer press used in the shaft hole forming step 50 is used. As illustrated in FIG. 20, the second punch 61 is attached to the upper die set 54, and the second die 62*b* is fixed to the lower die set 56.

The maximum diameter of the second punch 61 used in the shaft hole finishing step 60 is larger than the maximum diameter of the first punch 51 used in the shaft hole forming step 50 by 0.2 mm. The forged workpiece 33*b* cannot expand vertically due to the presence of the stripper 65*b* and the die holder 57*b* and cannot expand outward due to the presence of the second die 62*b*. Therefore, the diameter of the shaft hole 6 is increased by 0.2 mm in the shaft hole finishing step 60. At this time, excess metal does not become a slug but serves to compensate for a shear droop portion 6*a* (see FIG. 14), which is formed adjacent to a punching start point of the shaft hole forming step 50, or is absorbed in a small gap between the protrusion-including engagement portion 5*b* and the inner side wall of the second die 62*b*.

By using the second punch 61, the second die 62*b*, and a transfer press having a capacity of 500 ton, the shaft hole 6 having a diameter of about 8.8 mm, which has been formed in the protrusion-including engagement portion 5*b*, is finished so as to have a diameter of 9.0 mm.

Description of the shaft hole finishing step will be omitted, because it is the same as that of the first embodiment.

Description of the hole forming step 70 of the second embodiment will be omitted, because it is the same as that of the first embodiment.

Next, referring to FIGS. 21 to 25, a method of manufacturing an automobile door hinge according to a third embodiment of the present invention will be described.

The method of manufacturing an automobile door hinge according to the third embodiment differs from that of the first embodiment in a part of the structure of the body-side door hinge 1*a*.

To be specific, the structure of a body-side door hinge according to the third embodiment differs from that of the first embodiment in that the body-side door hinge according to the third embodiment has a substantially right-triangular plate-like shape in a front view when it is in use.

Figure 21:
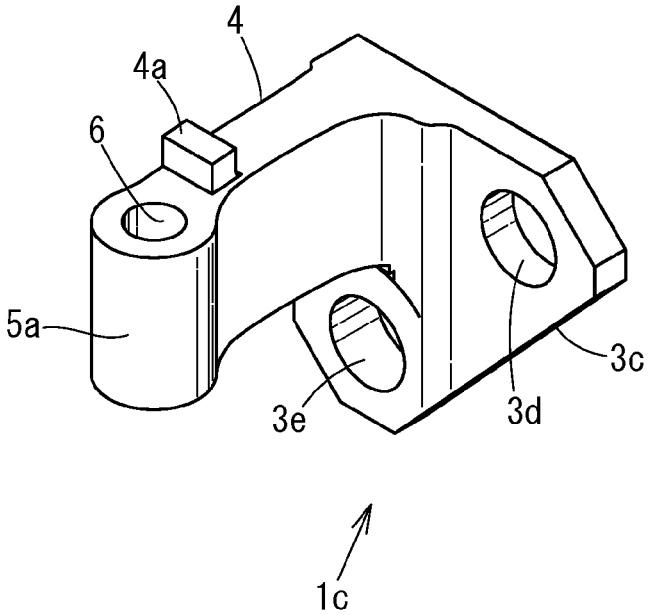
FIG. 21 is a perspective view of a body-side door hinge according to a third embodiment of the present invention.

FIG. 21 illustrates a body-side door hinge 1*c*, which is to be attached to an automobile body, made by the manufacturing method according to the third embodiment. As illustrated in FIG. 21, the body-side door hinge 1*c* includes a substantially right-triangular plate-like mounting portion 3*c*, a strip-shaped arm portion 4 that is bent away from the mounting portion 3*c* and that has a dimension smaller than the height dimension of the mounting portion 3*c*, and an engagement portion 5*a* formed at an end of the arm portion 4 and that has a cylindrical shape. The engagement portion 5*a* has a shaft hole 6, into which a hinge pin is to be inserted. A stopper 4*a* is formed on the arm portion 4, and mounting holes 3*d* and 3*e* are formed in the mounting portion 3*c*.

The body-side door hinge 1*c* according to the third embodiment has a horizontal dimension smaller than that of the body-side door hinge 1*a* according to the first embodiment and has a height dimension larger than that of the body-side door hinge 1*a*. Thus, the mounting hole 3*d* can be formed in an upper part of the mounting portion 3*c* and the mounting hole 3*e* can be formed in a lower part of the mounting portion 3*c*. Therefore, the body-side door hinge 1*c* can be attached to a portion of an automobile body having a small length in the horizontal direction.

Hereinafter, the steps the same as those of the first embodiment will be denoted by the same numerals and will not be described or will be described simply.

Description of the outline of the manufacturing method according to the third embodiment will be omitted, because the outline is the same as that of the first embodiment, which is illustrated in FIG. 1. In the following description, the steps and the numerals used in the first embodiment will be used.

In the third embodiment, the shape of the mounting portion 3*c* differs from that of the first embodiment. Therefore, a cutting step 20 of the third embodiment differs from that of the first embodiment in that a round steel bar used in the third embodiment has a diameter of 32 mm and a length of 70 mm, although it is a scale-covered S45c round steel bar as in the first embodiment. In other respects, the cutting step 20 is the same as that of the first embodiment.

Description of the heating step 25 will be omitted, because it is the same as that of the first embodiment.

Figure 22:
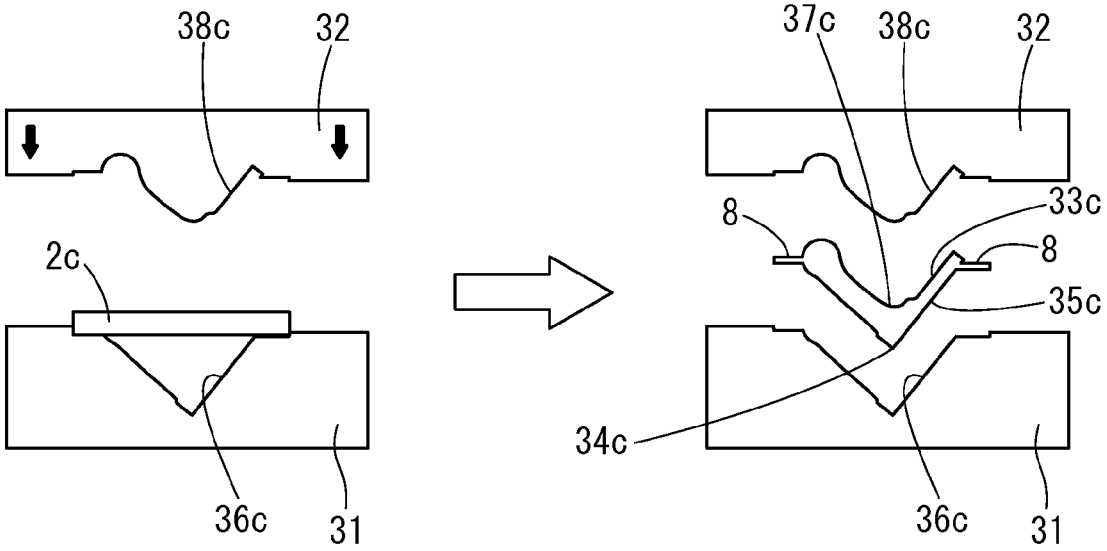
FIG. 22 illustrates a hot forging step according to the third embodiment of the present invention.

In a hot forging step 30 of the third embodiment, the structure of a forged workpiece 33*c* is different from that of the forged workpiece 33*a* of the first embodiment. Therefore, as illustrated in FIG. 22, the shape of a concave portion 36*c* in the lower die 31 is formed so as to receive a protruding surface 35*c* on a protruding side of a bent portion 34*c* of the forged workpiece 33*c*, and the shape of a convex portion 38*c* of the upper die 32 is formed so as to match the shape of an opposite surface 37*c* of the forged workpiece 33*c* opposite to the protruding surface 35*c*.

Description of the method of hot forging will be omitted, because it is the same as that of the first embodiment.

Description of a trimming step 40 and a cooling step 45 of the third embodiment will be omitted, because they are the same as those of the first embodiment.

In a shaft hole forming step 50 of the third embodiment, the shape of the forged workpiece 33*c* is different from that of the first embodiment. Therefore, a first die 52*c* is formed so as to have a shape illustrated in FIG. 23, and part of the structure of upper and lower die sets is changed as illustrated in FIG. 24.

The enlarged partial plan view of a column portion 7*c* and the first die 52*c* of the third embodiment will be omitted, because it is the same as FIG. 9 for the first embodiment.

Figure 23:
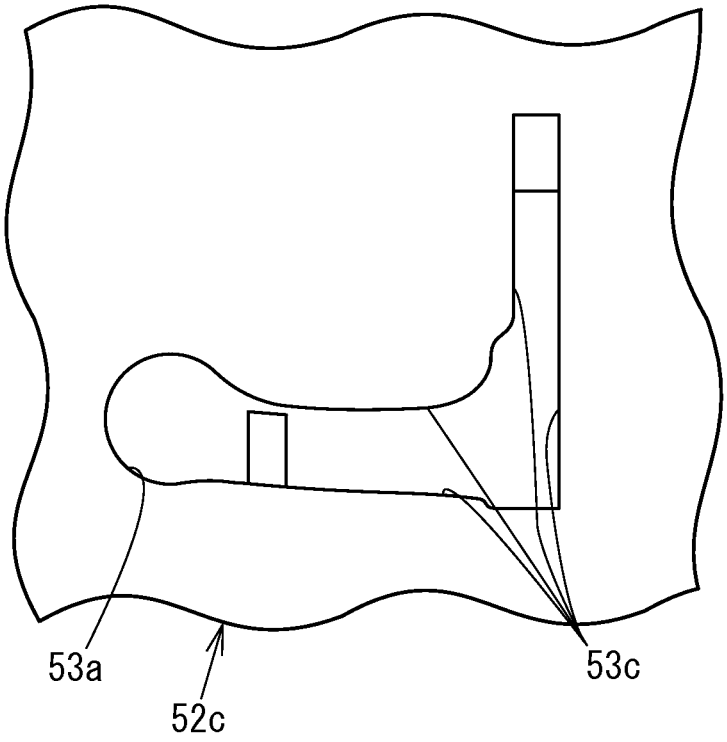
FIG. 23 is a plan view of a first die according to the third embodiment of the present invention.
Figure 24:
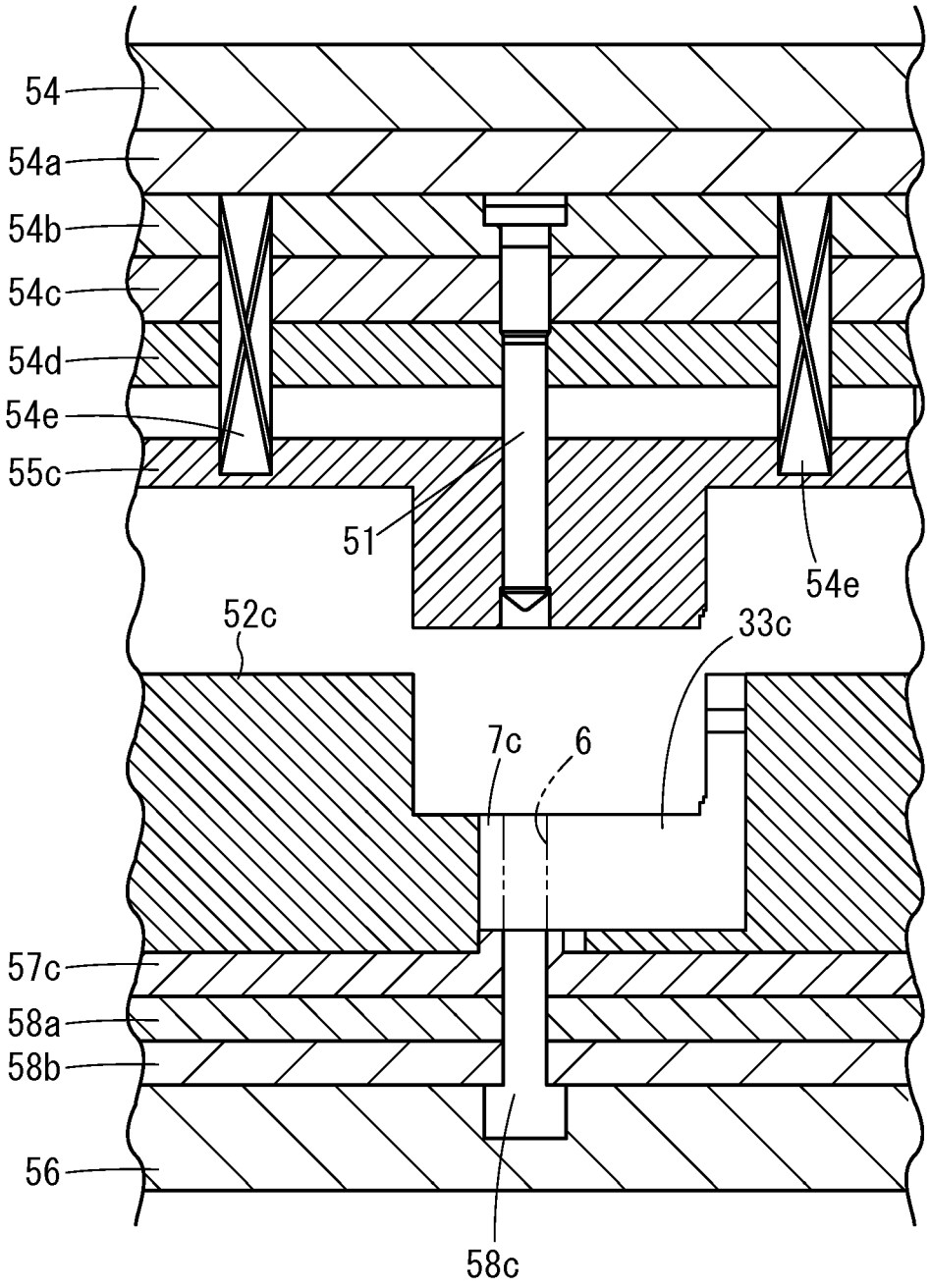
FIG. 24 is a sectional view of upper and lower die sets used in a shaft hole forming step according to the third embodiment of the present invention.

As illustrated in FIG. 23, the first die 52*c* has an inner side wall 53*a* that is separated from the outer periphery of the column portion 7*c* (not shown) of the forged workpiece 33*c* with a gap therebetween. A gap volume 53*b* between the outer periphery of the column portion 7*c* and the inner side wall 53*a* has such a size that, during punching of the column portion 7*c* of the forged workpiece 33*c* using the first punch 51, which has a diameter the same as that of the first embodiment and which has a shaft portion 51*c* that is longer than that of the first embodiment, a slug is not generated and the column portion 7*c* expands outward when the first punch 51 is pressed into the column portion 7*c* from a punching start point to a position at 4/5 of the length of the column portion 7*c*, and a slug is generated and discharged when the first punch 51 is pressed into the column portion 7*c* from the position at 4/5 of the length of the column portion 7*c* to a punching end point.

The inner side wall 53*c* of the first die 52*c*, which does not face the column portion 7*c*, has such a shape that the inner side wall 53*c* comes into contact with the outer peripheries of the mounting portion 3*c* and the arm portion 4 of the forged workpiece 33*c* without a gap therebetween. The column portion 7*c* of the forged workpiece 33*c* is positioned with respect to the inner side wall 53*c*.

By using the first punch 51, the first die 52*c*, and a transfer press having a capacity of 500 ton, the shaft hole 6 is formed in the axial center of the column portion 7*c*.

As illustrated in FIG. 24, the transfer press used in the shaft hole forming step has an upper die set 54, which moves up and down, and a lower die set 56, which is fixed to the transfer press. The first punch 51 is attached to the upper die set 54 using a punch plate 54*a*; punch holders 54*b*, 54*c*, and 54*d*; springs 54*e*; a stripper 55*c*; and the like. The first die 52*c* is attached to the lower die set 56 using a die holder 57*c*, die plates 58*a* and 58*b*, and the like.

Then, the forged workpiece 33*c* is inserted into the first die 52*c*. The upper die set 54 is lowered so that the stripper 55*c* of the upper die set 54 contacts the first die 52*c*. The forged workpiece 33*c*, excluding a portion in which the shaft hole 6 is to be formed, is vertically fixed between the stripper 55*c* and the die holder 57*c* using the springs 54*e*. Then, the shaft hole 6 is formed by lowering the first punch 51. When the first punch 51 is pressed into the column portion 7*c* from a punching start point to a position at 4/5 of the length of the column portion 7*c*, a slug is not generated and the column portion 7*c* expands outward so as to fill the gap volume 53*b* in the first die 52*c*. When the first punch 51 is pressed further into the column portion 7*c* from the position at 4/5 of the length of the column portion 7*c* to the punching end point, a slug is generated and discharged to the outside through a slug discharge hole 58*c*.

Next, the upper die set 54 is lifted to the initial position, a hydraulic device (not shown) pushes up the forged workpiece 33*c*, in which the shaft hole 6 has been formed, so as to remove the forged workpiece 33*c* from the first die 52*c*, thereby finishing the shaft hole forming step 50.

Thus, in the shaft hole forming step 50, the column portion 7*c* of the forged workpiece 33*c* is formed into an engagement portion 5*c*, which has a cylindrical shape having an inside diameter of 8.8 mm and a height of 24 mm.

After the shaft hole forming step 50, the forged workpiece 33*c* is turned upside down, and the shaft hole 6, which has been formed in the engagement portion 5*c* of the forged workpiece 33*c*, is finished in a shaft hole finishing step 60 by using the transfer press.

In the shaft hole finishing step 60, the shaft hole 6, which has been formed in the engagement portion 5*c* of the forged workpiece 33*c* in the shaft hole forming step 50, is finished with high precision by using a second die 62*c* and the second punch 61, which is the same as that of the first embodiment.

The second die 62*c* has an inner side wall having a shape the same as that of the first die 52*c*.

Because the forged workpiece 33*c* is inserted into the first die 52*c* and the second die 62*c* in vertically opposite orientations, the first die 52*c* and the second die 62*c* have shapes that are vertically symmetric to each other.

Figure 25:
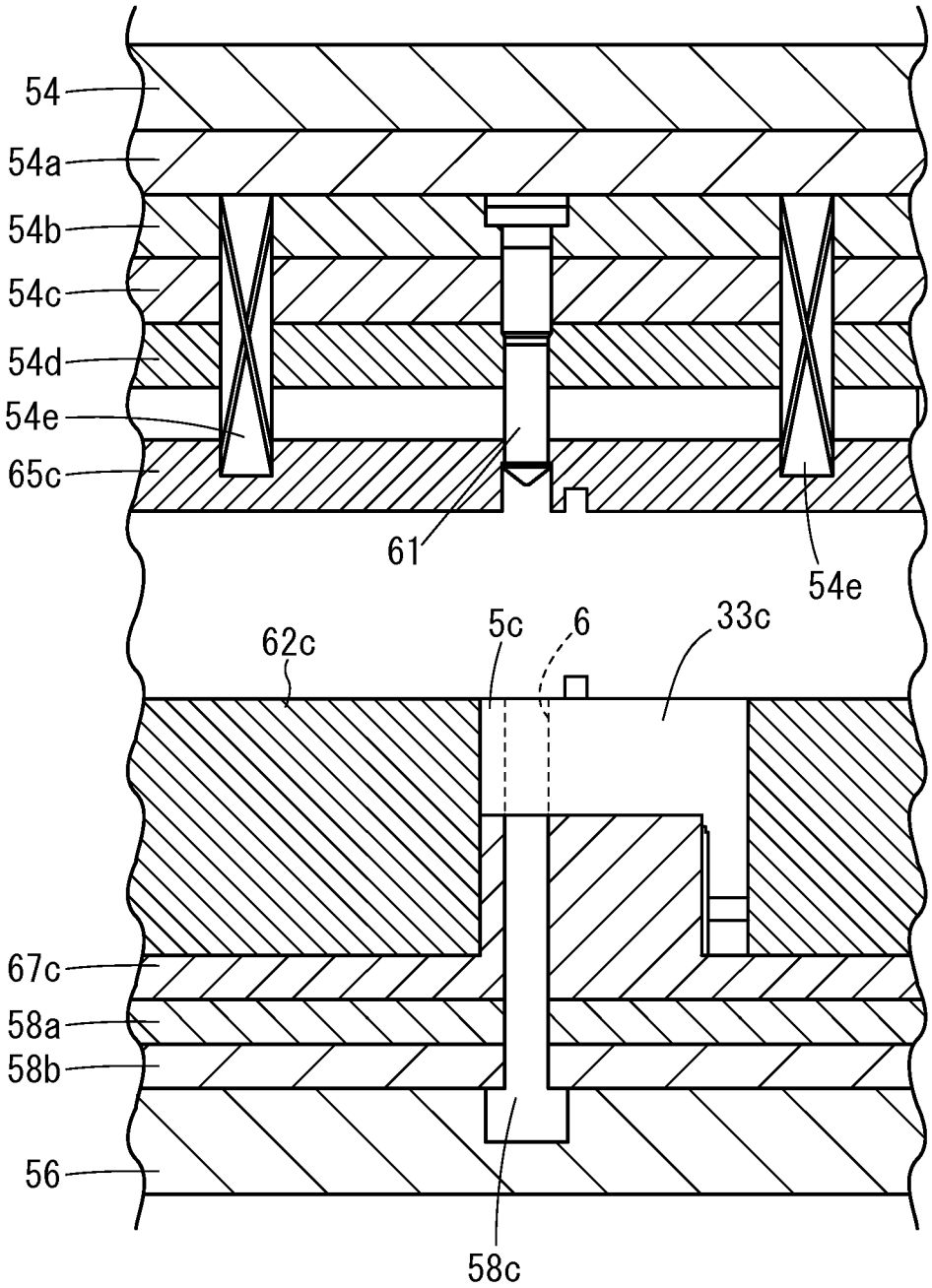
FIG. 25 is a sectional view of upper and lower die sets used in a shaft hole finishing step according to the third embodiment of the present invention.

Also in the shaft hole finishing step 60, the transfer press used in the shaft hole forming step 50 is used. As illustrated in FIG. 25, the second punch 61 is attached to the upper die set 54, and the second die 62*c* is fixed to the lower die set 56.

The maximum diameter of the second punch 61 used in the shaft hole finishing step 60 is larger than the maximum diameter of the first punch 51 used in the shaft hole forming step 50 by 0.2 mm. The forged workpiece 33*c* cannot expand vertically due to the presence of the stripper 65*c* and the die holder 67*c* and cannot expand outward due to the presence of the second die 62*c*. Therefore, the diameter of the shaft hole 6 is increased by 0.2 mm in the shaft hole finishing step 60. At this time, excess metal does not become a slug but serves to compensate for a shear droop portion 6*a* (see FIG. 14), which is formed adjacent to a punching start point of the shaft hole forming step 50, or is absorbed in a small gap between the engagement portion 5*c* and the inner side wall of the second die 62*c*.

By using the second punch 61, the second die 62*c*, and a transfer press having a capacity of 500 ton, the shaft hole 6 having a diameter of about 8.8 mm, which has been formed in the engagement portion 5*c*, is finished so as to have a diameter of 9.0 mm.

Description of the shaft hole finishing step will be omitted, because it is the same as that of the first embodiment.

Description of the hole forming step 70 of the third embodiment will be omitted, because it is the same as that of the first embodiment.

Next, referring to FIGS. 26 to 30, a method of manufacturing an automobile door hinge according to a fourth embodiment of the present invention will be described.

The method of manufacturing an automobile door hinge according to the fourth embodiment differs from that of the third embodiment in a part of the structure of the body-side door hinge 1*c*.

To be specific, the structure of a body-side door hinge according to the fourth embodiment differs from that of the third embodiment in that the body-side door hinge according to the fourth embodiment does not have the stopper, which is disposed on the arm portion of the third embodiment, and the engagement portion is a protrusion-including engagement portion having a door stop protrusion on a distal side of the cylindrical shape of the engagement portion.

Figure 26:
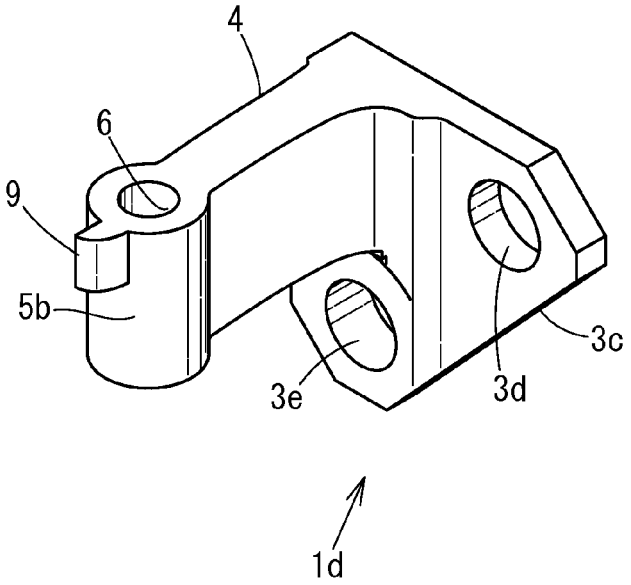
FIG. 26 is a perspective view of a body-side door hinge according to a fourth embodiment of the present invention.

FIG. 26 illustrates a body-side door hinge 1*d*, which is to be attached to an automobile body, made by the manufacturing method according to the fourth embodiment. As illustrated in FIG. 26, the body-side door hinge 1*d* includes a substantially right-triangular plate-like mounting portion 3*c*, a strip-shaped arm portion 4 that is bent away from the mounting portion 3*c* and that has a dimension smaller than the height dimension of the mounting portion 3*c*, and a protrusion-including engagement portion 5*b* that is disposed at an end of the arm portion 4 and that has a cylindrical shape. The protrusion-including engagement portion 5*b* has a shaft hole 6, into which a hinge pin is to be inserted, and a door stop protrusion 9 on a distal side of the cylindrical shape. Mounting holes 3*d* and 3*e* are formed in the mounting portion 3*c*.

The mounting portion 3*c*, the arm portion 4, and the protrusion-including engagement portion 5*b* of the body-side door hinge 1*d* have the same height. The door stop protrusion 9 is formed on an upper part of the protrusion-including engagement portion 5*b* having a length that is 1/3 of the height of the protrusion-including engagement portion 5*b*.

Hereinafter, the steps the same as those of the third embodiment will be denoted by the same numerals and will not be described or will be described simply.

Description of the outline of the manufacturing method according to the fourth embodiment will be omitted, because the outline is the same as that of the third (first) embodiment, which is illustrated in FIG. 1. In the following description, the steps and the numerals used in the third (first) embodiment will be used.

Description of a cutting step 20 and a heating step 25 of the fourth embodiment will be omitted, because they are the same as those of the third (first) embodiment.

Figure 27:
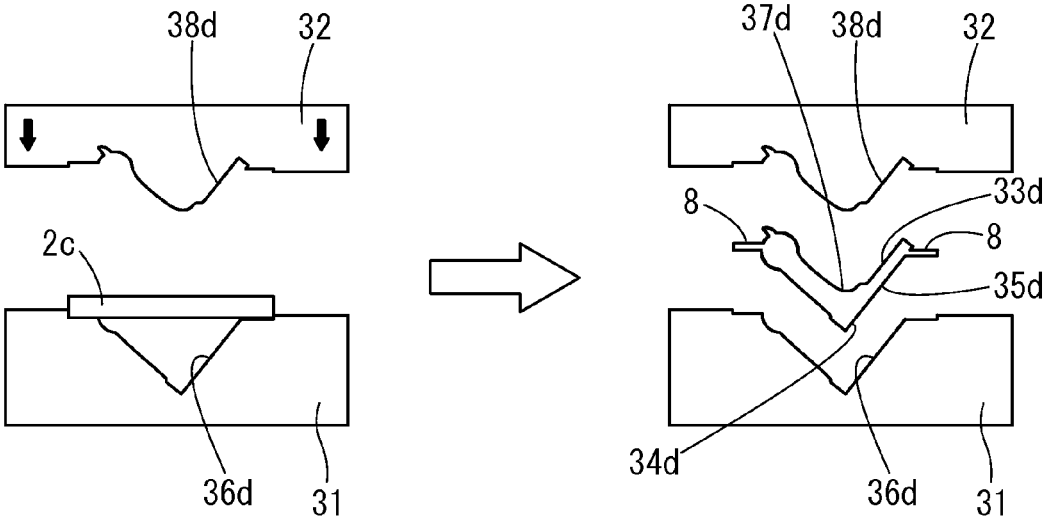
FIG. 27 illustrates a hot forging step according to the fourth embodiment of the present invention.
Figure 28:
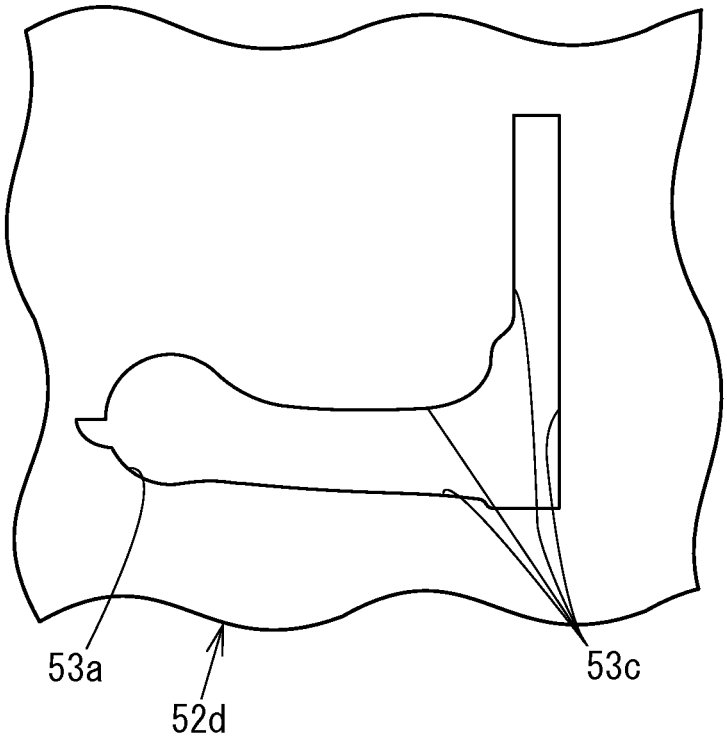
FIG. 28 is a plan view of a first die according to the fourth embodiment of the present invention.

In a hot forging step 30 of the fourth embodiment, the structure of a forged workpiece 33*d* is different from that of the forged workpiece 33*c* of the third embodiment. Therefore, as illustrated in FIG. 27, the shape of a concave portion 36*d* in the lower die 31 is formed so as to receive a protruding surface 35*d* on a protruding side of a bent portion 34*d* of the forged workpiece 33*d*, and the shape of a convex portion 38*d* of the upper die 32 is formed so as to match the shape of an opposite surface 37*d* of the forged workpiece 33*d* opposite to the protruding surface 35*d*.

Description of the method of hot forging will be omitted, because it is the same as that of the third (first) embodiment.

Description of a trimming step 40 and a cooling step 45 of the fourth embodiment will be omitted, because they are the same as those of the third (first) embodiment.

Figure 30:
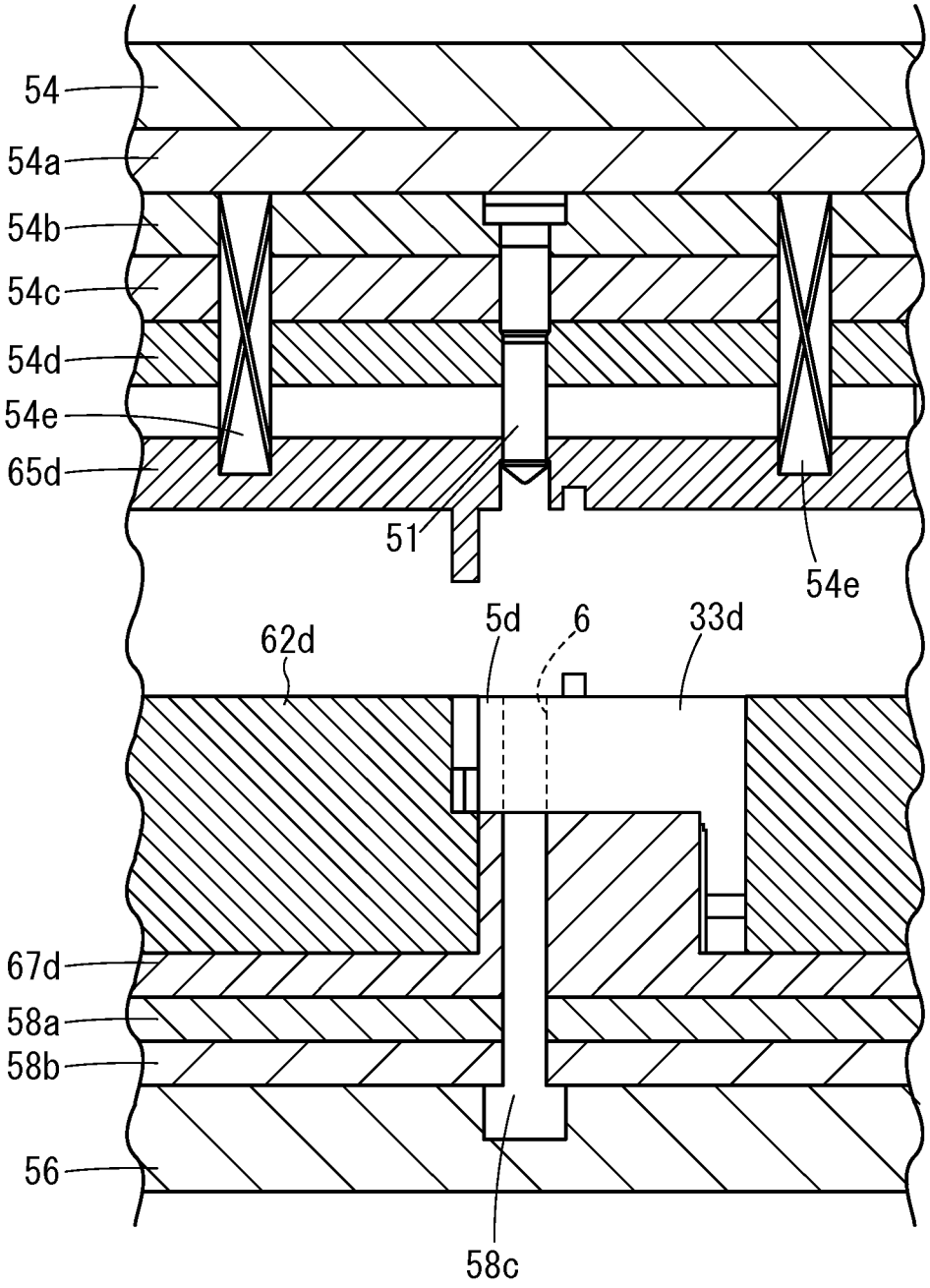
FIG. 30 is a sectional view of upper and lower die sets used in a shaft hole finishing step according to the fourth embodiment of the present invention.

In a shaft hole forming step 50 of the fourth embodiment, the shape of the forged workpiece 33*d* is different from that of the third embodiment. Therefore, a first die 52*d* is formed so as to have a shape illustrated in FIG. 28, and part of the structure of upper and lower die sets is changed as illustrated in FIG. 30.

As illustrated in FIG. 18 for the second embodiment, the first die 52*d* has an inner side wall 53*a* that is separated from a protrusion-including column portion 7*b* (shown by a dotted line) of the forged workpiece 33*d* with a gap therebetween. A gap volume 53*b* between the outer periphery of the protrusion-including column portion 7*b* and the inner side wall 53*a* has such a size that, during punching of the protrusion-including column portion 7*b* of the forged workpiece 33*d* using the first punch 51, which has a diameter the same as that of the first embodiment and has a shaft portion 51*c* that is longer than that of the first embodiment, a slug is not generated and the protrusion-including column portion 7*b* expands outward when the first punch 51 is pressed into the protrusion-including column portion 7*b* from a punching start point to a position at 4/5 of the length of the protrusion-including column portion 7*b*, and a slug is generated and discharged when the first punch 51 is pressed into the protrusion-including column portion 7*b* from the position at 4/5 of the length of the protrusion-including column portion 7*b* to a punching end point.

The inner side wall 53*c* of the first die 52*d*, which does not face the protrusion-including column portion 7*b*, has such a shape that the inner side wall 53*c* comes into contact with the outer peripheries of the mounting portion 3*c* and the arm portion 4 of the forged workpiece 33*d* without a gap therebetween. The protrusion-including column portion 7*b* of the forged workpiece 33*d* is positioned with respect to the inner side wall 53*c*.

By using the first punch 51, the first die 52*d*, and a transfer press having a capacity of 500 ton, the shaft hole 6 is formed in the axial center of the protrusion-including column portion 7*b*.

Figure 29:
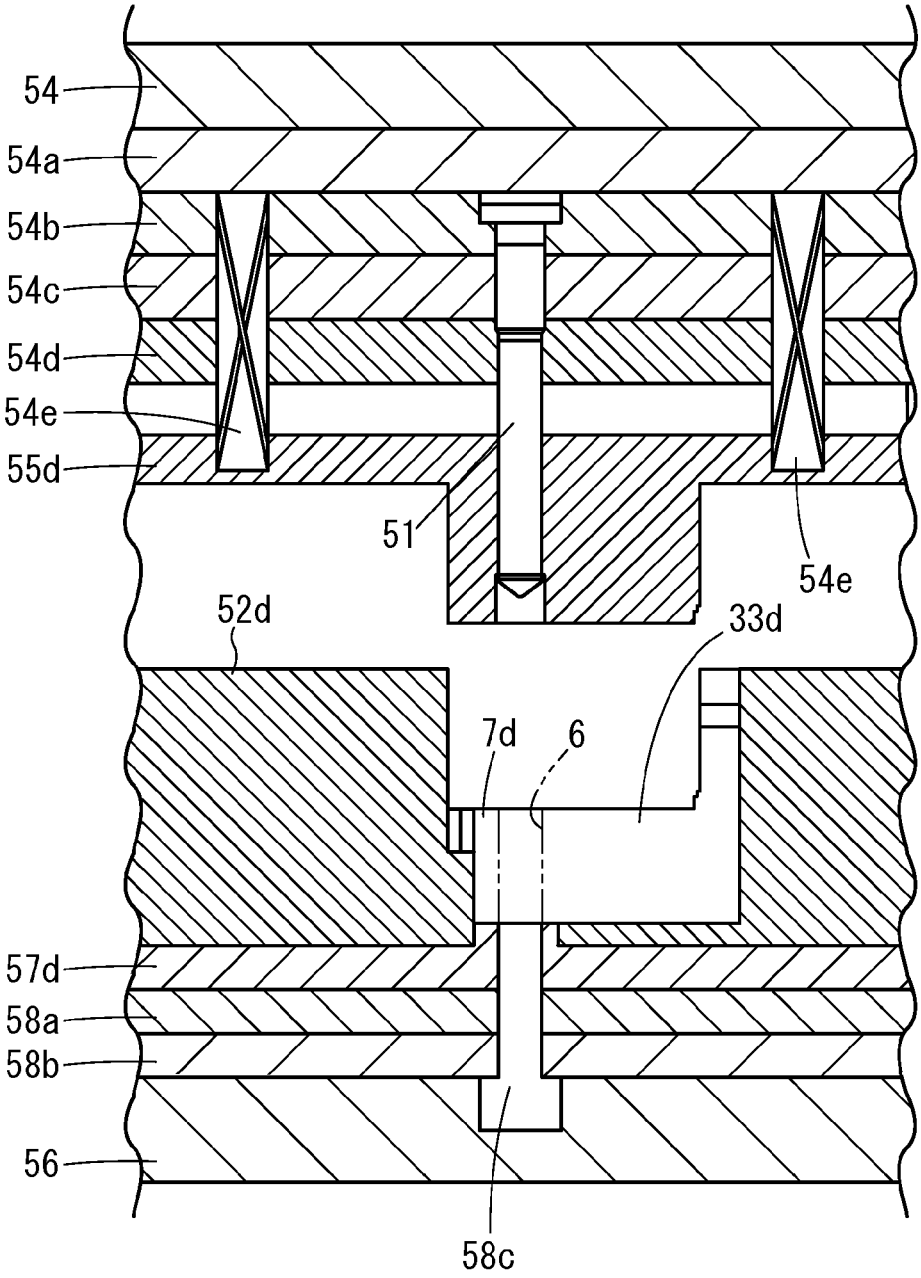
FIG. 29 is a sectional view of upper and lower die sets used in a shaft hole forming step according to the fourth embodiment of the present invention.

As illustrated in FIG. 29, the transfer press used in the shaft hole forming step has an upper die set 54, which moves up and down, and a lower die set 56, which is fixed to the transfer press. The first punch 51 is attached to the upper die set 54 using a punch plate 54*a*; punch holders 54*b*, 54*c*, and 54*d*; springs 54*e*; a stripper 55*d*; and the like. The first die 52*d* is attached to the lower die set 56 using a die holder 57*d*, die plates 58*a* and 58*b*, and the like.

Then, the forged workpiece 33*d* is inserted into the first die 52*d*. The upper die set 54 is lowered so that the stripper 55*d* of the upper die set 54 contacts the first die 52*d*. The forged workpiece 33*d*, excluding a portion in which the shaft hole 6 is to be formed, is vertically fixed between the stripper 55*d* and the die holder 57*d* using the springs 54*e*. Then, the shaft hole 6 is formed by lowering the first punch 51. When the first punch 51 is pressed into the protrusion-including column portion 7*b* from a punching start point to a position at 4/5 of the length of the protrusion-including column portion 7*b*, a slug is not generated and the protrusion-including column portion 7*b* expands outward so as to fill the gap volume 53*b* in the first die 52*d*. When the first punch 51 is pressed further into the protrusion-including column portion 7*b* from the position at 4/5 of the length of the protrusion-including column portion 7*b* to the punching end point, a slug is generated and discharged to the outside through a slug discharge hole 58*c*.

Next, the upper die set 54 is lifted to the initial position, a hydraulic device (not shown) pushes up the forged workpiece 33*d*, in which the shaft hole 6 has been formed, so as to remove the forged workpiece 33*d* from the first die 52*d*, thereby finishing the shaft hole forming step 50.

Thus, in the shaft hole forming step 50, the protrusion-including column portion 7*b* of the forged workpiece 33*d* is formed into the protrusion-including engagement portion 5*b* having an inside diameter of 8.8 mm and a height of 24 mm.

After the shaft hole forming step 50, the forged workpiece 33*d* is turned upside down, and the shaft hole 6, which has been formed in the protrusion-including engagement portion 5*b* of the forged workpiece 33*d*, is finished in a shaft hole finishing step 60 by using the transfer press.

In the shaft hole finishing step 60, the shaft hole 6, which has been formed in the protrusion-including engagement portion 5*b* of the forged workpiece 33*d* in the shaft hole forming step 50, is finished with high precision by using a second die 62*d* and the second punch 61, which is the same as that of the first embodiment.

The second die 62*d* has an inner side wall having a shape the same as that of the first die 52*d*, excluding a portion of the inner side wall of the second die 62*d* that is located below the protrusion 9 of the forged workpiece 33*d* in the first die 52*d*.

Because the forged workpiece 33*d* is inserted into the first die 52*d* and the second die 62*d* in vertically opposite orientations, the first die 52*d* and the second die 62*d* have shapes that are vertically symmetric to each other.

Also in the shaft hole finishing step 60, the transfer press used in the shaft hole forming step 50 is used. As illustrated in FIG. 30, the second punch 61 is attached to the upper die set 54, and the second die 62*d* is fixed to the lower die set 56.

The maximum diameter of the second punch 61 used in the shaft hole finishing step 60 is larger than the maximum diameter of the first punch 51 used in the shaft hole forming step 50 by 0.2 mm. The forged workpiece 33*d* cannot expand vertically due to the presence of the stripper 65*d* and the die holder 67*d* and cannot expand outward due to the presence of the second die 62*d*. Therefore, the diameter of the shaft hole 6 is increased by 0.2 mm in the shaft hole finishing step 60. At this time, excess metal does not become a slug but serves to compensate for a shear droop portion 6*a* (see FIG. 14), which is formed adjacent to a punching start point of the shaft hole forming step 50, or is absorbed in a small gap between the protrusion-including engagement portion 5*b* and the inner side wall of the second die 62*d*.

By using the second punch 61, the second die 62*d*, and a transfer press having a capacity of 500 ton, the shaft hole 6 having a diameter of about 8.8 mm, which has been formed in the protrusion-including engagement portion 5*b*, is finished so as to have a diameter of 9.0 mm.

Description of the shaft hole finishing step will be omitted, because it is the same as that of the third (first) embodiment.

Description of the hole forming step 70 of the fourth embodiment will be omitted, because it is the same as that of the third (first) embodiment.

In the third and fourth embodiments, the mounting portion 3*c* has a substantially right-triangular shape in front view when it is in use. Alternatively, the mounting portion 3*c* may have a polygonal shape, such as a rectangular or pentagonal shape.

Next, referring to FIGS. 31 to 36, a method of manufacturing an automobile door hinge according to a fifth embodiment of the present invention will be described.

The method of manufacturing an automobile door hinge according to the fifth embodiment is related to a door-side door hinge, which is to be attached to a door, whereas the methods of manufacturing an automobile door hinge according to the first to fourth embodiments is related to a body-side door hinge.

The structure of the door-side door hinge according to the fifth embodiment differs from the body-side door hinge according to first or third embodiment in the following respects: the door-side door hinge according to the fifth embodiment has a door stop protrusion on an engagement portion, whereas the body-side door hinge according to the first or third embodiment does not have a door stop protrusion but has an arm portion having a stopper; and the door-side door hinge has a small size due to limitation on a mounting space, does not have an arm portion, and has only one mounting hole.

Figure 31:
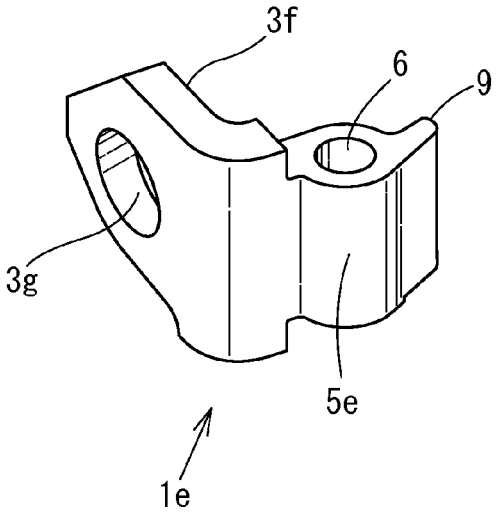
FIG. 31 is a perspective view of a door-side door hinge according to a fifth embodiment of the present invention.

FIG. 31 illustrates a door-side door hinge 1*e* made by the manufacturing method according to the fifth embodiment, which is to be attached to a door. As illustrated in FIG. 31, the door-side door hinge 1*e* includes a strip-shaped mounting portion 3*f* and a protrusion-including engagement portion 5*e* that is disposed in a portion bent away from the mounting portion 3*f* and that has a cylindrical shape. The protrusion-including engagement portion 5*e* has a shaft hole 6, into which a hinge pin is to be inserted, and a door stop protrusion 9 on a distal side of the cylindrical shape. A mounting hole 3*g* is formed in the mounting portion 3*f*.

In the door-side door hinge 1*e*, the height dimension of the protrusion-including engagement portion 5*e* is smaller than that of the mounting portion 3*f*. The height of the protrusion 9 is substantially the same as that of the protrusion-including engagement portion 5*e*.

Hereinafter, the steps the same as those of the first embodiment will be denoted by the same numerals and will not be described or will be described simply.

Description of the outline of the manufacturing method according to the fifth embodiment will be omitted, because the outline is the same as that of the first embodiment, which is illustrated in FIG. 1. In the following description, the steps and the numerals used in the first embodiment will be used.

In the fifth embodiment, the size of a forged workpiece 33*e* formed in a hot forging step 30 is small. Therefore, a cutting step 20 of the fifth embodiment differs from that of the first embodiment in that a round steel bar used in the fifth embodiment has a diameter of 26 mm and a length of 52 mm, although it is a scale-covered S45c round steel bar as in the first embodiment. In other respects, the cutting step 20 is the same as that of the first embodiment.

Description of a heating step 25 will be omitted, because it is the same as that of the first embodiment.

Figure 32:
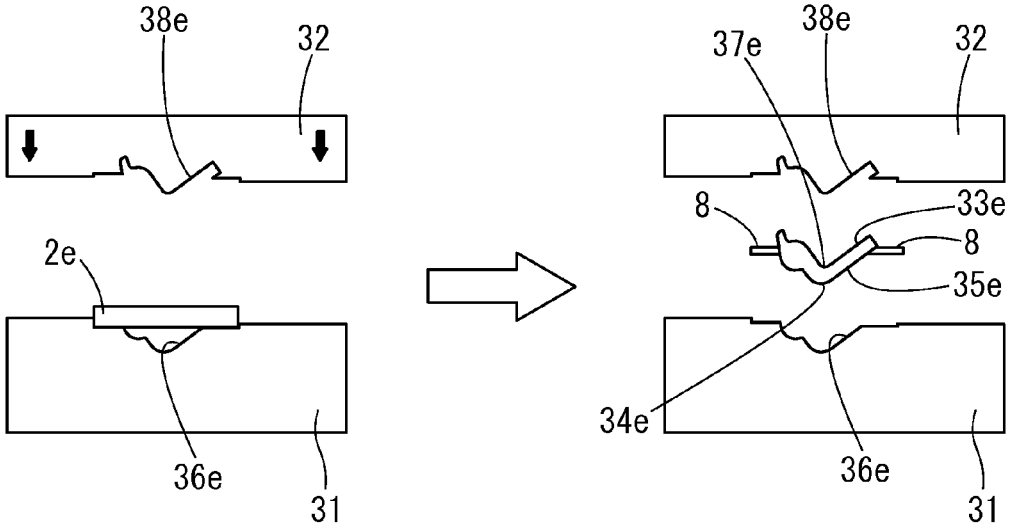
FIG. 32 illustrates a hot forging step according to the fifth embodiment of the present invention.

In the hot forging step 30 of the fifth embodiment, the structure of the forged workpiece 33*e* is different from that of the forged workpiece 33*a* of the first embodiment. Therefore, as illustrated in FIG. 32, the shape of a concave portion 36*e* in the lower die 31 is formed so as to receive a protruding surface 35*e* on a protruding side of a bent portion 34*e* of the forged workpiece 33*e*, and the shape of a convex portion 38*e* of the upper die 32 is formed so as to match the shape of an opposite surface 37*e* of the forged workpiece 33*e* opposite to the protruding surface 35*e*.

Description of the method of hot forging will be omitted, because it is the same as that of the first embodiment.

Description of a trimming step 40 and a cooling step 45 of the fifth embodiment will be omitted, because they are the same as those of the first embodiment.

Figure 35:
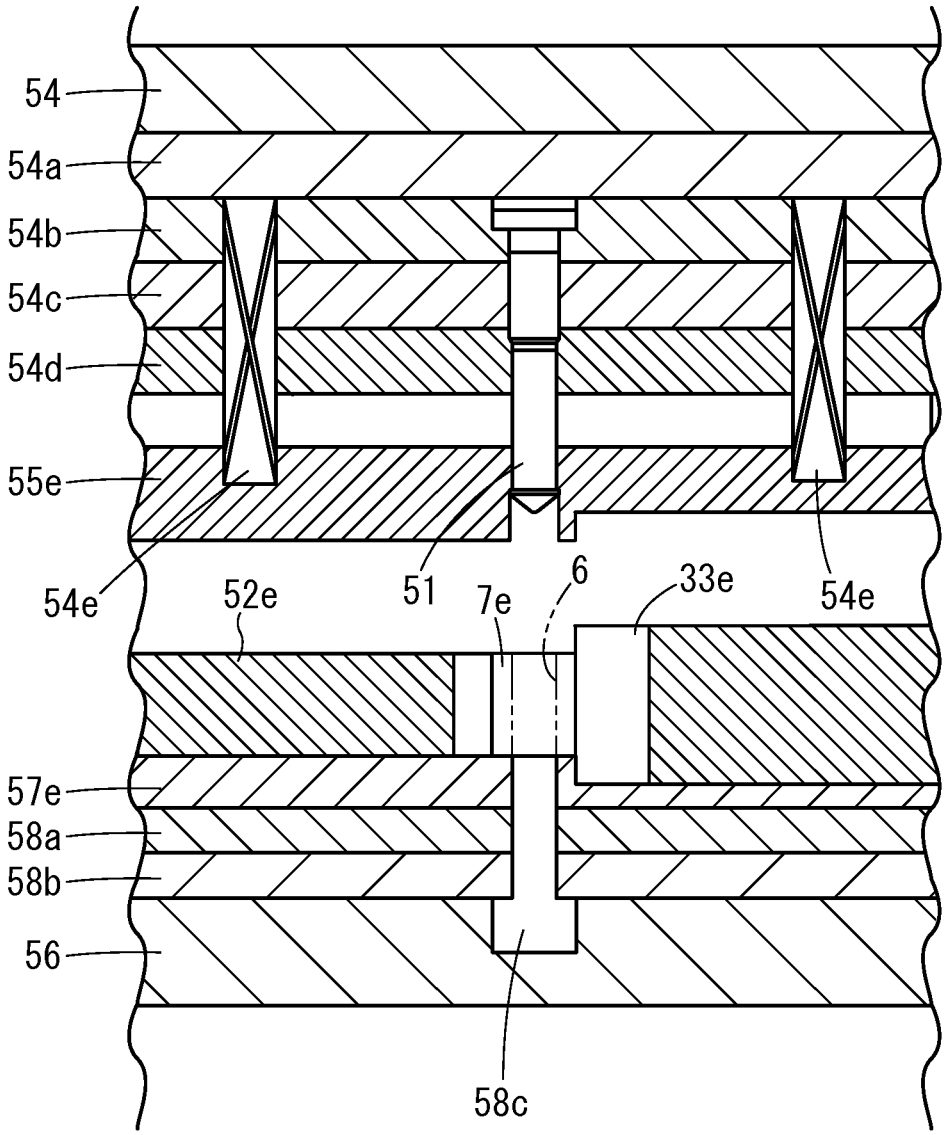
FIG. 35 is a sectional view of upper and lower die sets used in a shaft hole finishing step according to the fifth embodiment of the present invention.

In a shaft hole forming step 50 of the fifth embodiment, the shape of the forged workpiece 33*e* is different from that of the first embodiment. Therefore, a first die 52*e* is formed so as to have a shape illustrated in FIG. 33, and part of the structure of upper and lower die sets is changed as illustrated in FIG. 35.

Figure 33:
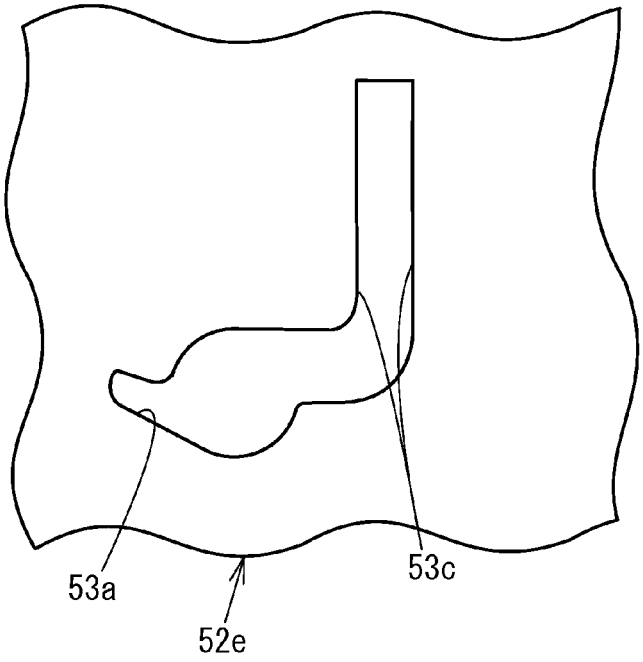
FIG. 33 is a plan view of a first die according to the fifth embodiment of the present invention.
Figure 34:
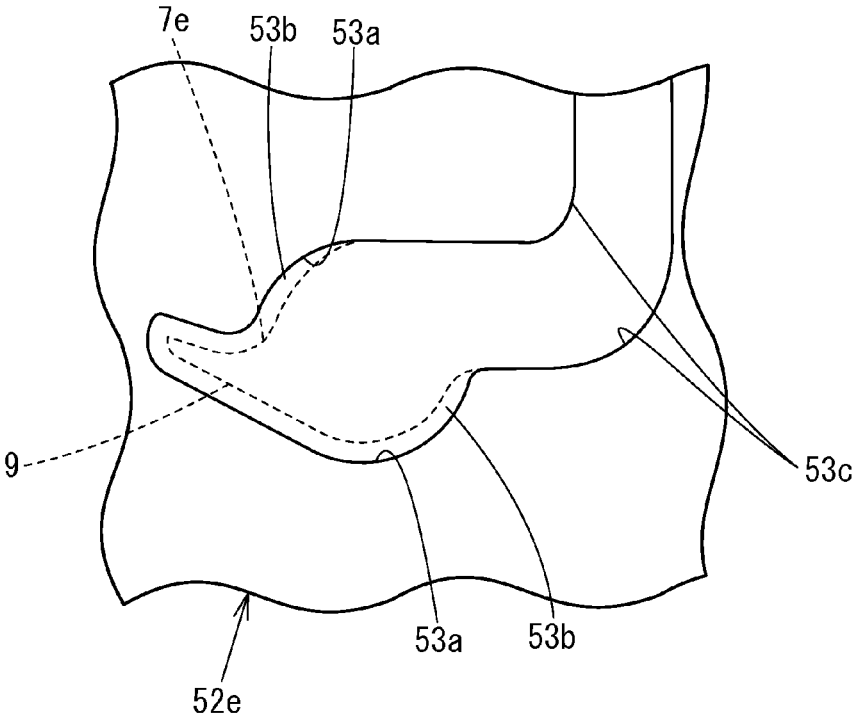
FIG. 34 is an enlarged partial plan view illustrating a protrusion-including column portion and a first die according to the fifth embodiment of the present invention.

As illustrated in FIGS. 33 and 34, the first die 52*e* has an inner side wall 53*a* that is separated from a protrusion-including column portion 7*e* (shown by a dotted line) of the forged workpiece 33*e* with a gap therebetween. A gap volume 53*b* between the outer periphery of the protrusion-including column portion 7*e* and the inner side wall 53*a* has such a size that, during punching of the protrusion-including column portion 7*e* of the forged workpiece 33*e* using the first punch 51, which is the same as that of the first embodiment, a slug is not generated and the protrusion-including column portion 7*e* expands outward when the first punch 51 is pressed into the protrusion-including column portion 7*e* from a punching start point to a position at 4/5 of the length of the protrusion-including column portion 7*e*, and a slug is generated and discharged when the first punch 51 is pressed into the protrusion-including column portion 7*e* from the position at 4/5 of the length of the protrusion-including column portion 7*e* to a punching end point.

The inner side wall 53*c* of the first die 52*e*, which does not face the protrusion-including column portion 7*e*, has such a shape that the inner side wall 53*c* comes into contact with the outer periphery of the mounting portion 3*f* of the forged workpiece 33*e* without a gap therebetween. The protrusion-including column portion 7*e* of the forged workpiece 33*e* is positioned with respect to the inner side wall 53*c*.

By using the first punch 51, the first die 52*e*, and a transfer press having a capacity of 500 ton, the shaft hole 6 is formed in the axial center of the protrusion-including column portion 7*e*.

As illustrated in FIG. 35, the transfer press used in the shaft hole forming step has an upper die set 54, which moves up and down, and a lower die set 56, which is fixed to the transfer press. The first punch 51 is attached to the upper die set 54 using a punch plate 54*a*; punch holders 54*b*, 54*c*, and 54*d*; springs 54*e*; a stripper 55*e*; and the like. The first die 52*e* is attached to the lower die set 56 using a die holder 57*e*, die plates 58*a* and 58*b*, and the like.

Then, the forged workpiece 33*e* is inserted into the first die 52*e*. The upper die set 54 is lowered so that the stripper 55*e* of the upper die set 54 contacts the first die 52*e*. The forged workpiece 33*e*, excluding a portion in which the shaft hole 6 is to be formed, is vertically fixed between the stripper 55*e* and the die holder 57*e* using the springs 54*e*. Then, the shaft hole 6 is formed by lowering the first punch 51. When the first punch 51 is pressed into the protrusion-including column portion 7*e* from a punching start point to a position at 4/5 of the length of the protrusion-including column portion 7*e*, a slug is not generated and the protrusion-including column portion 7*e* expands outward so as to fill the gap volume 53*b* in the first die 52*e*. When the first punch 51 is pressed further into the protrusion-including column portion 7*e* from the position at 4/5 of the length of the protrusion-including column portion 7*e* to the punching end point, a slug is generated and discharged to the outside through a slug discharge hole 58*c*.

Next, the upper die set 54 is lifted to the initial position, a hydraulic device (not shown) pushes up the forged workpiece 33*e*, in which the shaft hole 6 has been formed, so as to remove the forged workpiece 33*e* from the first die 52*e*, thereby finishing the shaft hole forming step 50.

Thus, in the shaft hole forming step 50, the protrusion-including column portion 7*e* of the forged workpiece 33*e* is formed into the protrusion-including engagement portion 5*e* having an inside diameter of 8.8 mm and a height of 24 mm.

After the shaft hole forming step 50, the forged workpiece 33*e* is turned upside down, and the shaft hole 6, which has been formed in the protrusion-including engagement portion 5*e* of the forged workpiece 33*e*, is finished in a shaft hole finishing step 60 by using the transfer press.

In the shaft hole finishing step 60, the shaft hole 6, which has been formed in the protrusion-including engagement portion 5*e* of the forged workpiece 33*e* in the shaft hole forming step 50, is finished with high precision by using a second die 62*e* and the second punch 61, which is the same as that of the first embodiment.

The second die 62*e* has an inner side wall having a shape the same as that of the first die 52*e*.

Because the forged workpiece 33*e* is inserted into the first die 52*e* and the second die 62*e* in vertically opposite orientations, the first die 52*e* and the second die 62*e* have shapes that are vertically symmetric to each other.

Figure 36:
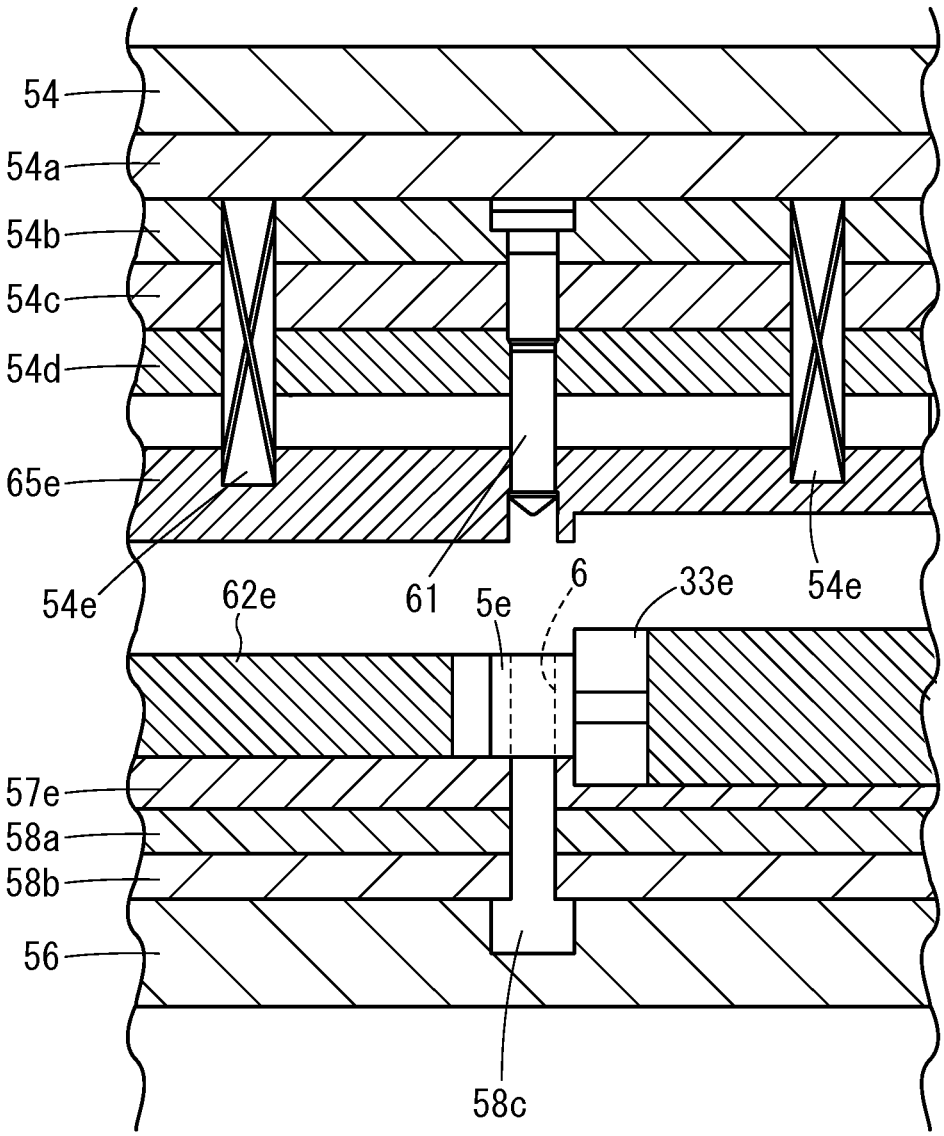
FIG. 36 is a sectional view of upper and lower die sets used in a shaft hole finishing step according to the fifth embodiment of the present invention.

Also in the shaft hole finishing step 60, the transfer press used in the shaft hole forming step 50 is used. As illustrated in FIG. 36, the second punch 61 is attached to the upper die set 54, and the second die 62*e* is fixed to the lower die set 56.

The maximum diameter of the second punch 61 used in the shaft hole finishing step 60 is larger than the maximum diameter of the first punch 51 used in the shaft hole forming step 50 by 0.2 mm. The forged workpiece 33*e* cannot expand vertically due to the presence of the stripper 65*e* and the die holder 57*e* and cannot expand outward due to the presence of the second die 62*e*. Therefore, the diameter of the shaft hole 6 is increased by 0.2 mm in the shaft hole finishing step 60. At this time, excess metal does not become a slug but serves to compensate for a shear droop portion 6*a* (see FIG. 14), which is formed adjacent to a punching start point of the shaft hole forming step 50, or is absorbed in a small gap between the protrusion-including engagement portion 5*e* and the inner side wall of the second die 62*e*.

By using the second punch 61, the second die 62*e*, and a transfer press having a capacity of 500 ton, the shaft hole 6 having a diameter of about 8.8 mm, which has been formed in the protrusion-including engagement portion 5*e*, is finished so as to have a diameter of 9.0 mm.

Description of the shaft hole finishing step will be omitted, because it is the same as that of the first embodiment.

Description of the hole forming step 70 of the fifth embodiment will be omitted, because it is the same as that of the first embodiment.

Next, referring to FIGS. 37 to 42, a method of manufacturing an automobile door hinge according to a sixth embodiment of the present invention will be described.

The method of manufacturing an automobile door hinge according to the sixth embodiment differs from that of the fifth embodiment in a part of the structure of the door-side door hinge to be attached to a door.

To be specific, the structure of a door-side door hinge according to the sixth embodiment differs from that of the fifth embodiment in that the door-side door hinge according to the sixth embodiment has an engagement portion that does not have a protrusion, whereas the door-side door hinge according to the fifth embodiment has a protrusion-including engagement portion having a door stop protrusion.

Figure 37:
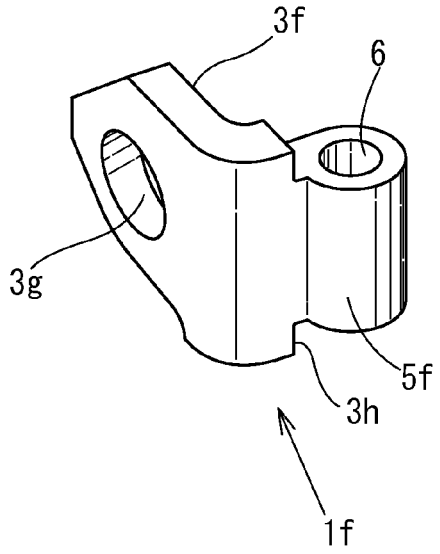
FIG. 37 is a perspective view of a door-side door hinge according to a sixth embodiment of the present invention.

FIG. 37 illustrates a door-side door hinge if made by the manufacturing method according to the sixth embodiment, which is to be attached to a door. As illustrated in FIG. 37, the door-side door hinge if includes a strip-shaped mounting portion 3*f* and an engagement portion 5*f* that is disposed in a portion bent away from the mounting portion 3*f* and that has a cylindrical shape. The engagement portion 5*f* has a shaft hole 6, into which a hinge pin is to be inserted. A mounting hole 3*g* is formed in the mounting portion 3*f*.

In the door-side door hinge 1*f*, the height dimension of the engagement portion 5*f* is smaller than that of the mounting portion 3*f*. An end portion of the mounting portion 3*f* on which the engagement portion 5*f* is not disposed serves as a stopper 3*h*.

Hereinafter, the steps the same as those of the fifth embodiment will be denoted by the same numerals and will not be described or will be described simply.

Description of the outline of the manufacturing method according to the sixth embodiment will be omitted, because the outline is the same as that of the fifth (first) embodiment, which is illustrated in FIG. 1. In the following description, the steps and the numerals used in the fifth (first) embodiment will be used.

Description of a cutting step 20 and a heating step 25 of the sixth embodiment will be omitted, because they are the same as those of the fifth (first) embodiment.

Figure 38:
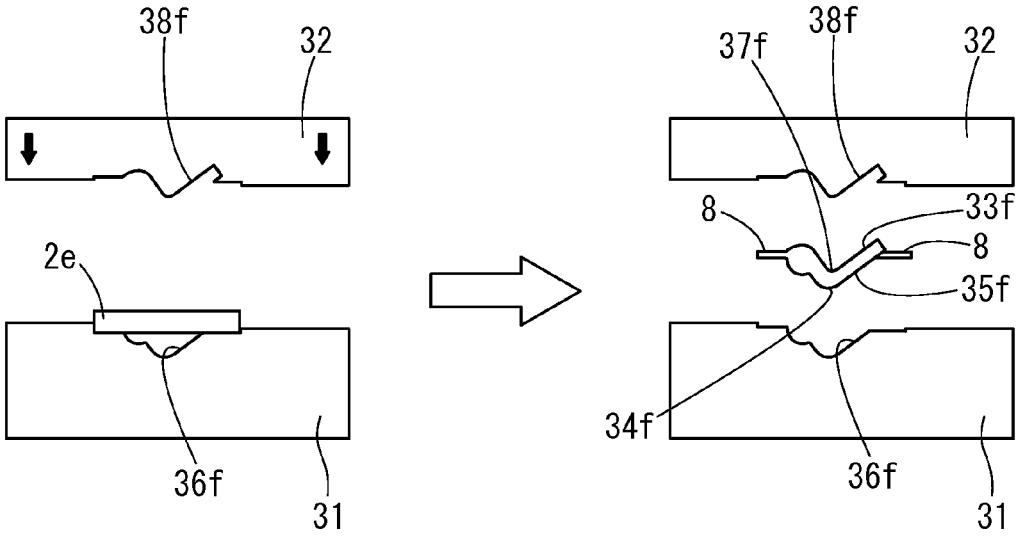
FIG. 38 illustrates a hot forging step according to the sixth embodiment of the present invention.

In the hot forging step 30 of the sixth embodiment, the structure of a forged workpiece 33*f* is different from that of the forged workpiece 33*e* of the fifth embodiment. Therefore, as illustrated in FIG. 38, the shape of a concave portion 36*f* in the lower die 31 is formed so as to receive a protruding surface 35*f* on a protruding side of a bent portion 34*f* of the forged workpiece 33*f*, and the shape of a convex portion 38*f* of the upper die 32 is formed so as to match the shape of an opposite surface 37*f* of the forged workpiece 33*f* opposite to the protruding surface 35*f*.

Description of the method of hot forging will be omitted, because it is the same as that of the fifth (first) embodiment.

Description of a trimming step 40 and a cooling step 45 of the sixth embodiment will be omitted, because they are the same as those of the fifth (first) embodiment.

Figure 41:
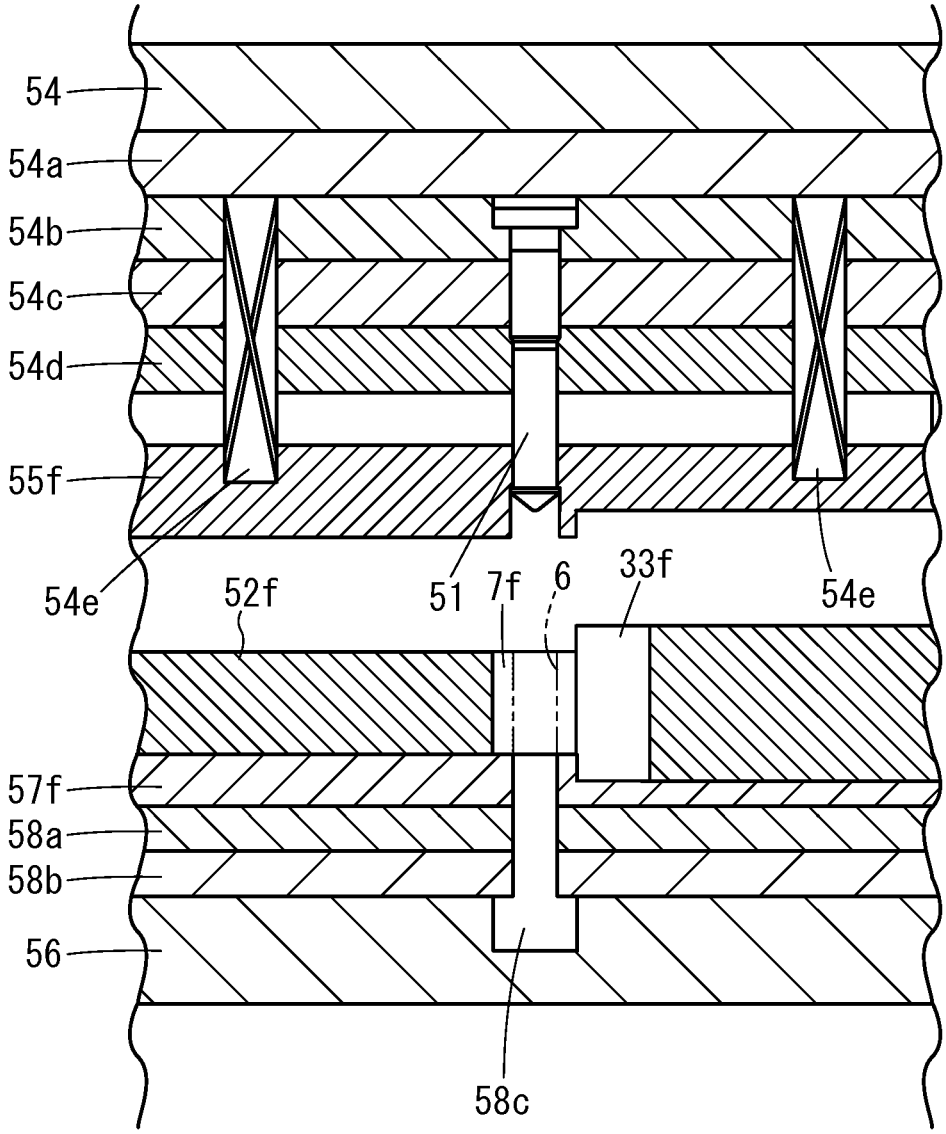
FIG. 41 is a sectional view of upper and lower die sets used in a shaft hole forming step according to the sixth embodiment of the present invention.

In a shaft hole forming step 50 of the sixth embodiment, the shape of the forged workpiece 33*f* is different from that of the fifth embodiment. Therefore, a first die 52*f* is formed so as to have a shape illustrated in FIG. 39, and part of the structure of upper and lower die sets is changed as illustrated in FIG. 41.

Figure 39:
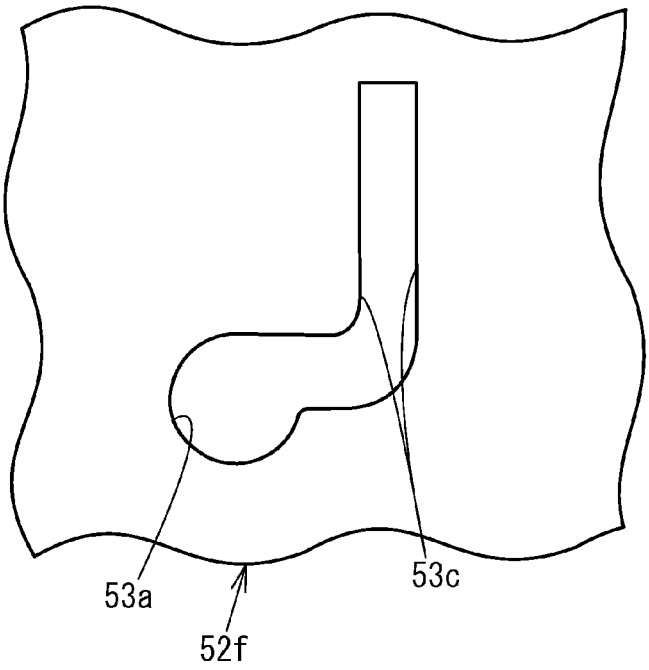
FIG. 39 is a plan view of a first die according to the sixth embodiment of the present invention.
Figure 40:
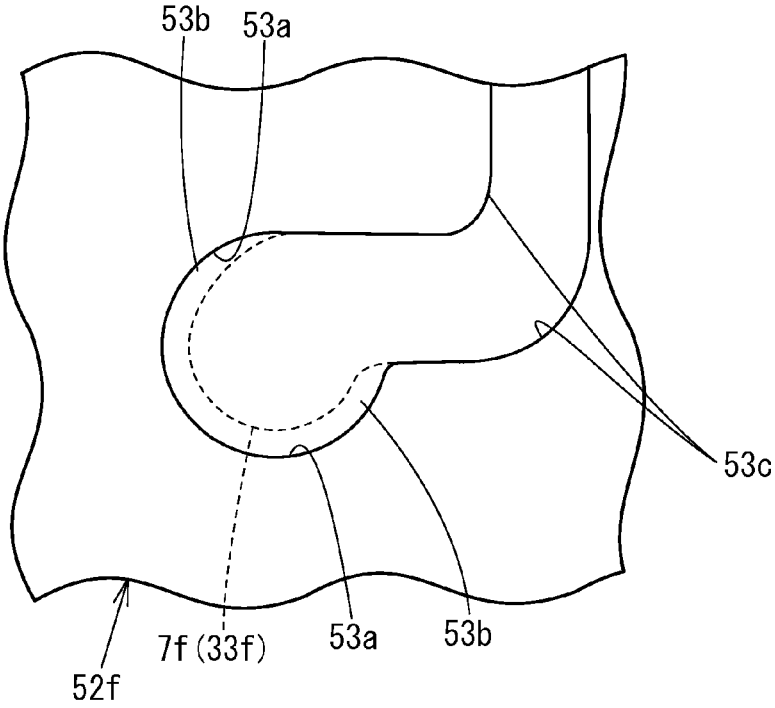
FIG. 40 is an enlarged partial plan view illustrating a column portion and a first die according to the sixth embodiment of the present invention.

As illustrated in FIGS. 39 and 40, the first die 52*f* has an inner side wall 53*a* that is separated from a column portion 7*f* (shown by a dotted line) of the forged workpiece 33*f* with a gap therebetween. A gap volume 53*b* between the outer periphery of the column portion 7*f* and the inner side wall 53*a* has such a size that, during punching of the column portion 7*f* of the forged workpiece 33*f* using the first punch 51, which is the same as that of the first embodiment, a slug is not generated and the column portion 7*f* expands outward when the first punch 51 is pressed into the column portion 7*f* from a punching start point to a position at 4/5 of the length of the column portion 7*f*, and a slug is generated and discharged when the first punch 51 is pressed into the column portion 7*f* from the position at 4/5 of the length of the column portion 7*f* to a punching end point.

The inner side wall 53*c* of the first die 52*f*, which does not face the column portion 7*f*, has such a shape that the inner side wall 53*c* comes into contact with the outer periphery of the mounting portion 3*f* of the forged workpiece 33*f* without a gap therebetween. The column portion 7*f* of the forged workpiece 33*f* is positioned with respect to the inner side wall 53*c*.

By using the first punch 51, the first die 52*f*, and a transfer press having a capacity of 500 ton, the shaft hole 6 is formed in the axial center of the column portion 7*f*.

As illustrated in FIG. 41, the transfer press used in the shaft hole forming step has an upper die set 54, which moves up and down, and a lower die set 56, which is fixed to the transfer press. The first punch 51 is attached to the upper die set 54 using a punch plate 54*a*; punch holders 54*b*, 54*c*, and 54*d*; springs 54*e*; a stripper 55*f*; and the like. The first die 52*f* is attached to the lower die set 56 using a die holder 57*f*, die plates 58*a* and 58*b*, and the like.

Then, the forged workpiece 33*f* is inserted into the first die 52*f*. The upper die set 54 is lowered so that the stripper 55*f* of the upper die set 54 contacts the first die 52*f*. The forged workpiece 33*f*, excluding a portion in which the shaft hole 6 is to be formed, is vertically fixed between the stripper 55*f* and the die holder 57*f* using the springs 54*e*. Then, the shaft hole 6 is formed by lowering the first punch 51. When the first punch 51 is pressed into the column portion 7*f* from a punching start point to a position at 4/5 of the length of the column portion 7*f*, a slug is not generated and the column portion 7*f* expands outward so as to fill the gap volume 53*b* in the first die 52*f*. When the first punch 51 is pressed further into the column portion 7*f* from the position at 4/5 of the length of the column portion 7*f* to the punching end point, a slug is generated and discharged to the outside through a slug discharge hole 58*c*.

Next, the upper die set 54 is lifted to the initial position, a hydraulic device (not shown) pushes up the forged workpiece 33*f*, in which the shaft hole 6 has been formed, so as to remove the forged workpiece 33*f* from the first die 52*f*, thereby finishing the shaft hole forming step 50.

Thus, in the shaft hole forming step 50, the column portion 7*f* of the forged workpiece 33*f* is formed into the engagement portion 5*f* having an inside diameter of 8.8 mm and a height of 24 mm.

After the shaft hole forming step 50, the forged workpiece 33*f* is turned upside down, and the shaft hole 6, which has been formed in the engagement portion 5*f* of the forged workpiece 33*f*, is finished in a shaft hole finishing step 60 by using the transfer press.

In the shaft hole finishing step 60, the shaft hole 6, which has been formed in the engagement portion 5*f* of the forged workpiece 33*f* in the shaft hole forming step 50, is finished with high precision by using a second die 62*f* and the second punch 61, which is the same as that of the first embodiment.

The second die 62*f* has an inner side wall having a shape the same as that of the first die 52*f*.

Because the forged workpiece 33*f* is inserted into the first die 52*f* and the second die 62*f* in vertically opposite orientations, the first die 52*f* and the second die 62*f* have shapes that are vertically symmetric to each other.

Figure 42:
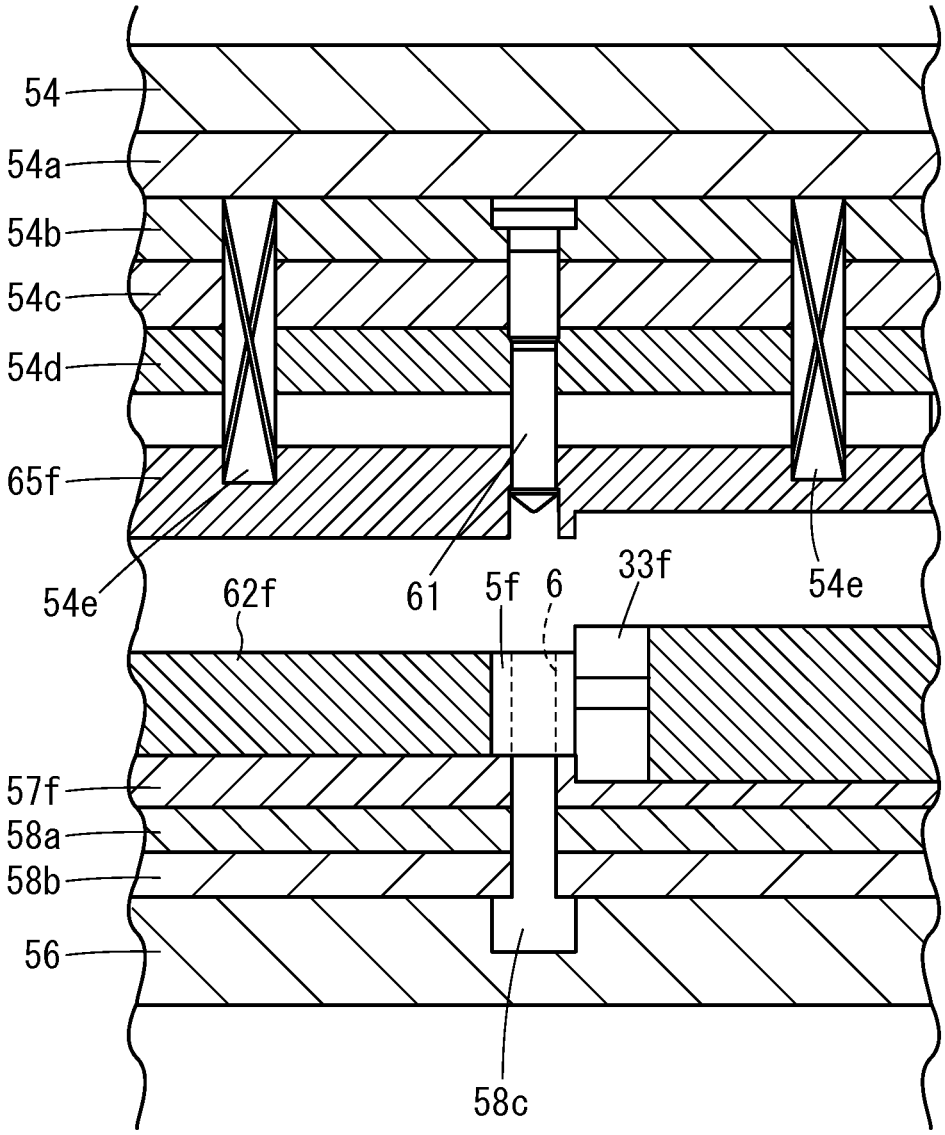
FIG. 42 is a sectional view of upper and lower die sets in a shaft hole finishing step according to the sixth embodiment of the present invention.

Also in the shaft hole finishing step 60, the transfer press used in the shaft hole forming step 50 is used. As illustrated in FIG. 42, the second punch 61 is attached to the upper die set 54, and the second die 62*f* is fixed to the lower die set 56.

The maximum diameter of the second punch 61 used in the shaft hole finishing step 60 is larger than the maximum diameter of the first punch 51 used in the shaft hole forming step 50 by 0.2 mm. The forged workpiece 33*f* cannot expand vertically due to the presence of the stripper 65*f* and the die holder 57*f* and cannot expand outward due to the presence of the second die 62*f*. Therefore, the diameter of the shaft hole 6 is increased by 0.2 mm in the shaft hole finishing step 60. At this time, excess metal does not become a slug but serves to compensate for a shear droop portion 6*a* (see FIG. 14), which is formed adjacent to a punching start point of the shaft hole forming step 50, or is absorbed in a small gap between the engagement portion 5*f* and the inner side wall of the second die 62*f*.

By using the second punch 61, the second die 62*f*, and a transfer press having a capacity of 500 ton, the shaft hole 6 having a diameter of about 8.8 mm, which has been formed in the engagement portion 5*f*, is finished so as to have a diameter of 9.0 mm.

Description of the shaft hole finishing step will be omitted, because it is the same as that of the first embodiment.

Description of the hole forming step 70 of the sixth embodiment will be omitted, because it is the same as that of the fifth (first) embodiment.

The manufacturing methods according to the first to sixth embodiments each include the cutting step 20, the heating step 25, the hot forging step 30, the trimming step 40, the cooling step 45, the shaft hole forming step 50, the shaft hole finishing step 60, and the hole forming step 70. The inventions according to the first to sixth embodiments are characterized in the hot forging step, the shaft hole forming step, and the shaft hole finishing step. The cutting step, the heating step, the trimming step, the cooling step, and the hole forming step may be omitted or may be performed in other steps.

In the first to sixth embodiments, the temperature of the material used in the hot forging step 30 is increased to 1200° C.±50° C. in the heating step 25. Alternatively, this temperature may be in the range of 950° C. to 1350° C. If this temperature is lower than 950° C., a hot forging device (such as an air stamp hammer) needs to have a high capacity. If this temperature is higher than 1350° C., the forged workpiece becomes decarburized and has insufficient strength.

In the first to sixth embodiments, a column portion or a protrusion-including column portion having a circular horizontal cross section is formed in the hot forging step 30. Alternatively, as illustrated in FIGS. 43A and 43B, the column portion or the protrusion-including column portion may have an elliptical horizontal cross section.

Figure 43A:
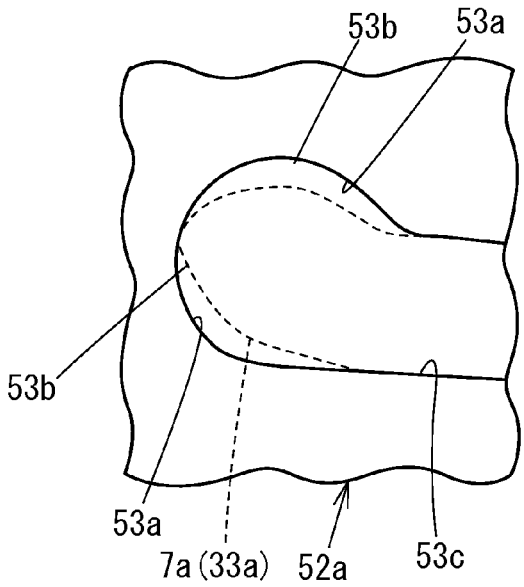
FIGS. 43A and 43B are enlarged partial plan views illustrating modifications of the first to sixth embodiments of the present invention, FIG. 43A illustrating a column portion and a first die, and FIG. 43B illustrating a protrusion-including column portion and a first die.
Figure 43B:
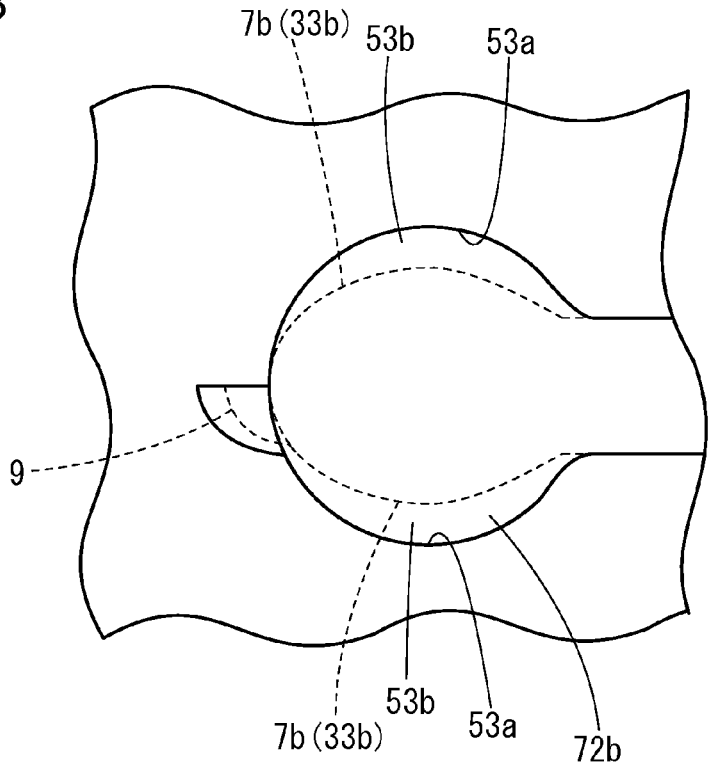

FIG. 43A is an enlarged partial plan view, which corresponds to FIG. 9 of the first embodiment, illustrating a column portion 7*a* having an elliptical horizontal cross section and a first die 52*a*. FIG. 43B is an enlarged partial plan view, which corresponds to FIG. 18 of the second embodiment, illustrating a protrusion-including column portion 7*b* having an elliptical horizontal cross section and a first die 52*b*. Although not illustrated, in each of the third to sixth embodiments, the column portion or the protrusion-including column portion may have an elliptical horizontal cross section.

In the first to sixth embodiments, the trimming step 40 is performed after the hot forging step while the forged workpiece is hot. Alternatively, the trimming step 40 may be performed by warm working when the forged workpiece has a temperature in the range of 450° C. to 900° C. or may be performed by cold working after the cooling step 45. In a case where the trimming step is performed by warm working, the temperature of forged workpiece in the cooling step 45 is adjusted to be in the range of 450° C. to 900° C.

In the first to sixth embodiments, the tips of the first punch 51 and the second punch 61 each have a vertex angle of 90°. It is preferable that the vertex angle be in the range of 70° to 120°.

It is not preferable that the vertex angle of the first punch 51 be smaller than 70° because, in this case, excess metal in the shaft hole moves toward the outer periphery of the punch, so that a large stress is exerted on the punch and the punch may become broken.

It is not preferable that the vertex angle of the first punch 51 be larger than 120° because of the following reasons: a pushing force oriented forward into the shaft hole is exerted strongly and metal around the shaft hole is pulled in the direction in which the shaft hole extends, so that a large stress is exerted on the punch and the punch may also become broken; and a large shear droop portion is formed adjacent to a punching start point of the shaft hole and may cause a trouble in practical use.

The second punch 61 may have a frusto-conical shape instead of a conical shape.

In the first to sixth embodiments, the gap volume 53*b*, which is provided between the outer periphery of each of the column portions 7*a*, 7*c*, and 7*f* and the protrusion-including column portions 7*b*, 7*d*, and 7*e* and the inner side wall 53*a* or 53*c* of a corresponding one of the first dies 52*a* to 52*f*, has a size that satisfies the following conditions. That is, when the first punch 51 is pressed into the column portion 7*a*, 7*c*, or 7*f*, or the protrusion-including column portion 7*b*, 7*d*, or 7*e* of one of the forged workpieces 33*a* to 33*f*, a slug is not generated and the column portion 7*a*, 7*c*, or 7*f* or the protrusion-including column portion 7*b*, 7*d*, or 7*e* expands outward when the first punch 51 is pressed into the column portion 7*a*, 7*c*, or 7*f* or the protrusion-including column portion 7*b*, 7*d*, or 7*e* from a punching start point to a position at 4/5 of the length of the column portion 7*a*, 7*c*, or 7*f* or the protrusion-including column portion 7*b*, 7*d*, or 7*e*, and a slug is generated and discharged when the first punch 51 is pressed into the column portion 7*a*, 7*c*, or 7*f* or the protrusion-including column portion 7*b*, 7*d*, or 7*e* from the position at 4/5 of the length of the column portion 7*a*, 7*c*, or 7*f* or the protrusion-including column portion 7*b*, 7*d*, or 7*e* to a punching end point. Alternatively, the value 4/5 may be substituted by a value in the range of 3/4 to 5/6.

It is not preferable that this value be outside of this range because, if this value is smaller than 3/4, the column portion does not expand in a lower part of the gap volume 53*b*, and if this value is larger than 5/6, an excessively large stress is exerted on the first punch.

In the first to sixth embodiments, the shaft hole forming step 50 and the shaft hole finishing step 60 are performed by cold working. Alternatively, the shaft hole forming step and the shaft hole finishing step may be performed by warm working.

To perform these steps by warm working, the temperature of the forged workpiece in the cooling step 45 is adjusted to be in the range of 450° C. to 900° C.

In this case, the dimensions of the first punch, the first die, the second punch, and the second die are determined with consideration of thermal expansion of the forged workpiece during warm working and thermal contraction during use at room temperature.

That is, because the punches and dies are made of a material that has a small coefficient of thermal expansion, the first punch, the first die, the second punch, and the second die are manufactured so as to have dimensions that are larger than the design values for use at room temperature with consideration of the temperatures during warm working and the difference in the coefficients of thermal expansion.

Next, referring to FIGS. 44A and 44B, a method of manufacturing an automobile door hinge according to a seventh embodiment of the present invention will be described.

The seventh embodiment is a method of manufacturing a pair of automobile door hinges by using a body-side door hinge that is manufactured by the method of manufacturing an automobile door hinge according to the first embodiment and a door-side door hinge that is manufactured by the method of manufacturing an automobile door hinge according to the fifth embodiment.

Figure 44A:
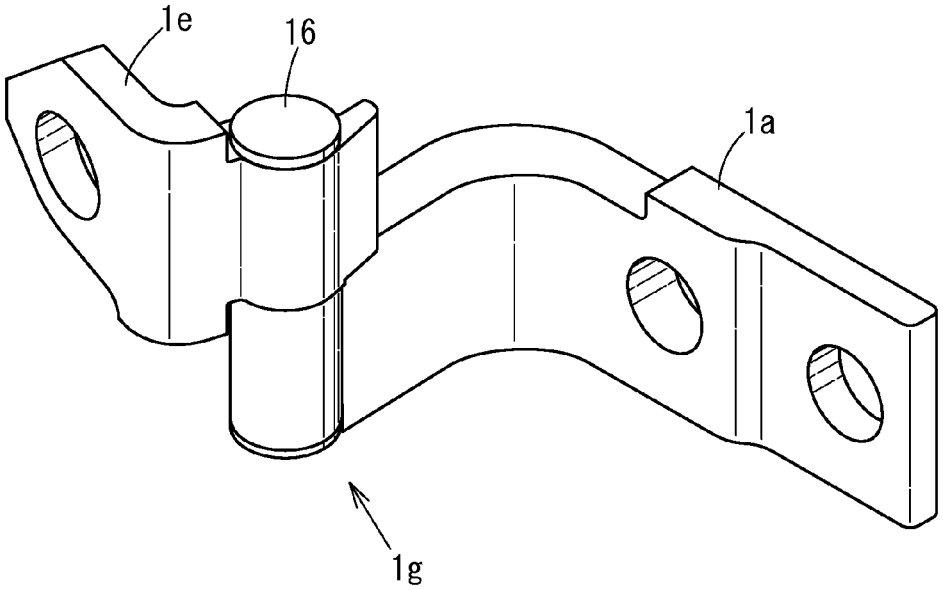
FIG. 44A is a perspective view and FIG. 44B is a front view of a pair of automobile door hinges according to a seventh embodiment of the present invention.
Figure 44B:
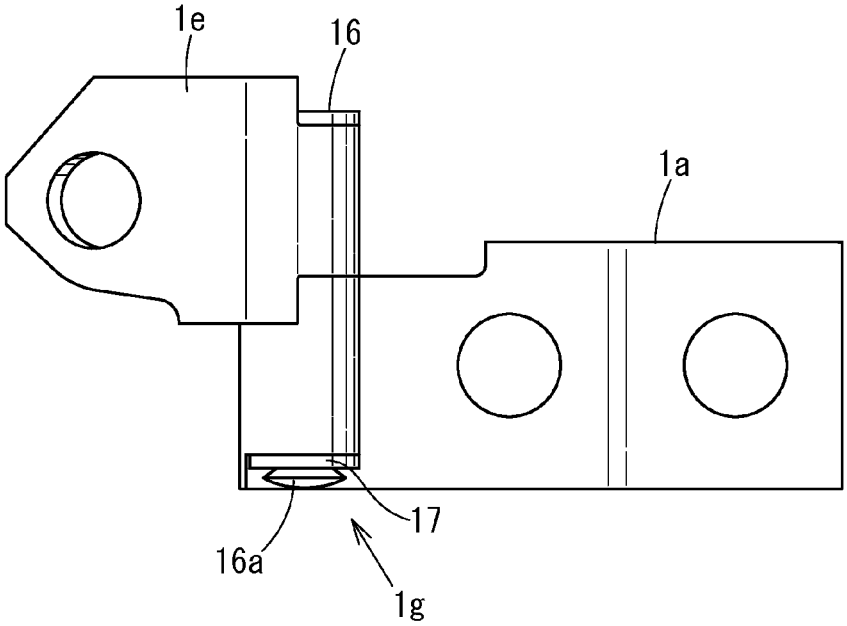

FIGS. 44A and 44B illustrate a pair of automobile door hinges 1*g* that is made from the body-side door hinge 1*a*, which is manufactured by the method according to the first embodiment and which is to be attached to an automobile body, and a door-side door hinge 1*e*, which is manufactured by the method according to the fifth embodiment. A headed hinge pin 16 is inserted into the shaft holes in the door hinges 1*a* and 1*e* so that the headed hinge pin extends through the shaft holes. Then, an end portion 16*a* of the headed hinge pin 16 is swaged. Thus, the pair of automobile door hinges 1*g* is made.

A washer 17 is disposed at an end of the headed hinge pin 16.

Next, referring to FIGS. 45A and 45B, a method of manufacturing an automobile door hinge according to an eighth embodiment of the present invention will be described.

The eighth embodiment is a method of manufacturing a pair of automobile door hinges by using a body-side door hinge that is manufactured by the method of manufacturing an automobile door hinge according to the second embodiment and a door-side door hinge that is manufactured by the method of manufacturing an automobile door hinge according to the sixth embodiment.

Figure 45A:
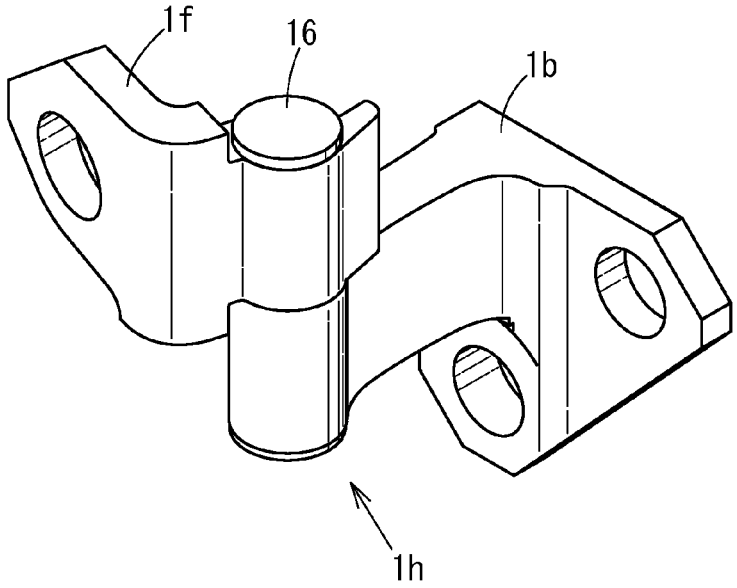
FIG. 45A is a perspective view and FIG. 45B is a front view of a pair of automobile door hinges according to an eighth embodiment of the present invention.
Figure 45B:
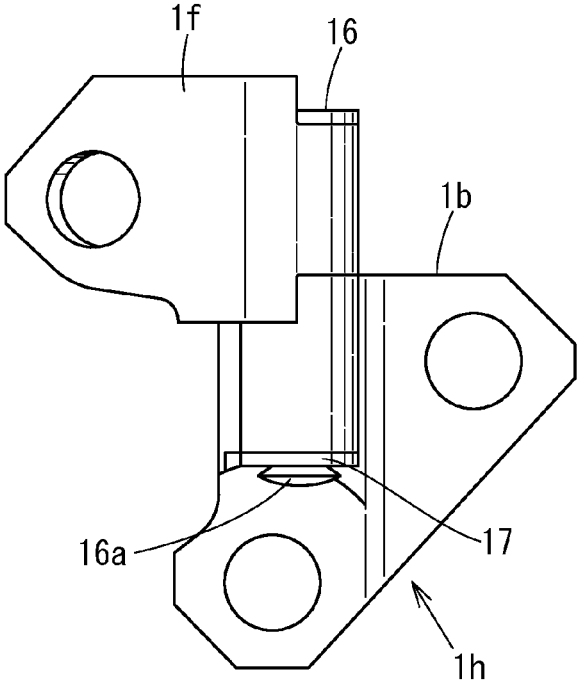

FIGS. 45A and 45B illustrate a pair of automobile door hinges 1*h* that is made from the body-side door hinge 1*b*, which is manufactured by the method according to the second embodiment and which is to be attached to an automobile body, and the door-side door hinge 1*f*, which is manufactured by the method according to the sixth embodiment. A headed hinge pin 16 is inserted into the shaft holes in the door hinges 1*b* and 1*f* so that the headed hinge pin extends through the shaft holes. Then, an end portion 16*a* of the headed hinge pin 16 is swaged. Thus, the pair of automobile door hinges 1*h* is made.

A washer 17 is disposed at an end of the headed hinge pin 16.

Next, referring to FIGS. 46A and 46B, a method of manufacturing an automobile door hinge according to a ninth embodiment of the present invention will be described.

The ninth embodiment is a method of manufacturing a pair of automobile door hinges by using a body-side door hinge that is manufactured by the method of manufacturing an automobile door hinge according to the third embodiment and a door-side door hinge that is manufactured by the method of manufacturing a door hinge according to the fifth embodiment.

Figure 46A:
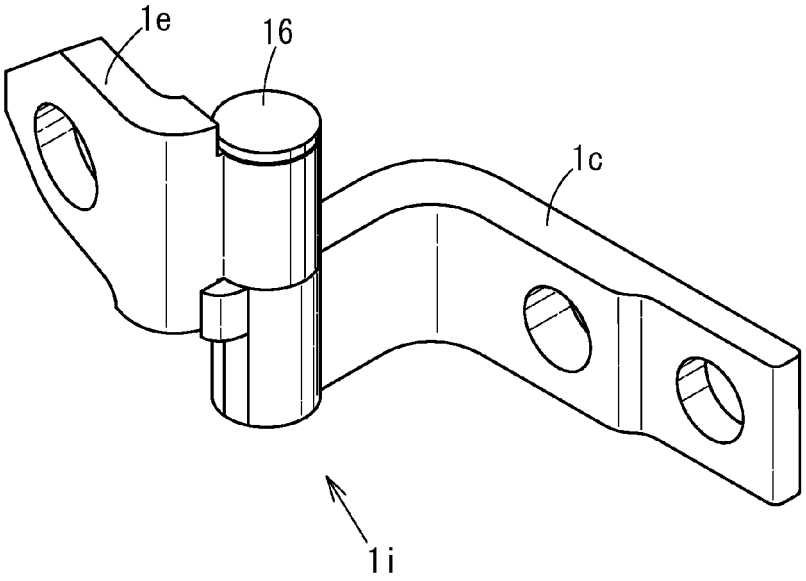
FIG. 46A is a perspective view and FIG. 46B is a front view of a pair of automobile door hinges according to a ninth embodiment of the present invention.
Figure 46B:
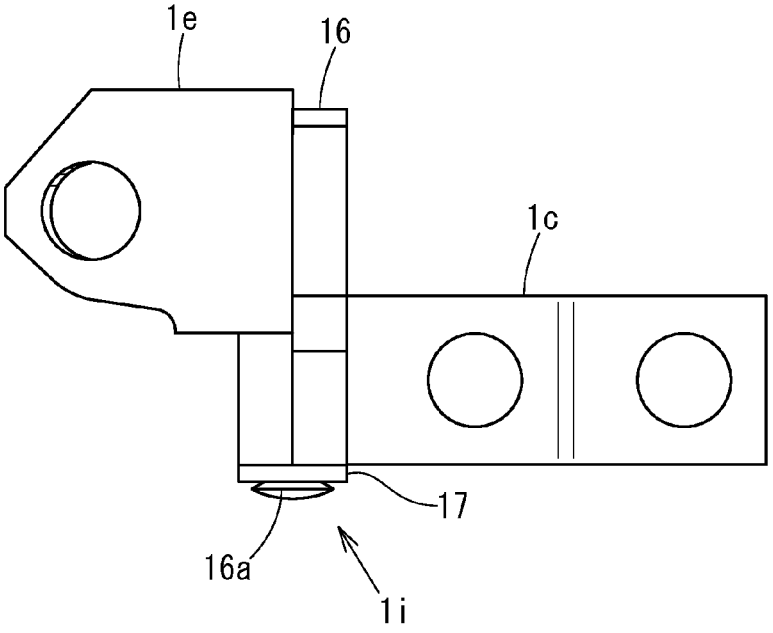

FIGS. 46A and 46B illustrate a pair of automobile door hinges 1*i* that is made from the body-side door hinge 1*c*, which is manufactured by the method according to the third embodiment and which is to be attached to an automobile body, and the door-side door hinge 1*e*, which is manufactured by the method according to the fifth embodiment. A headed hinge pin 16 is inserted into the shaft holes in the door hinges 1*c* and 1*e* so that the headed hinge pin extends through the shaft holes. Then, an end portion 16*a* of the headed hinge pin 16 is swaged. Thus, the pair of automobile door hinges 1*i* is made.

A washer 17 is disposed at an end of the headed hinge pin 16.

Next, referring to FIGS. 47A and 47B, a method of manufacturing an automobile door hinge according to a tenth embodiment of the present invention will be described.

The tenth embodiment is a method of manufacturing a pair of automobile door hinges by using a body-side door hinge that is manufactured by the method of manufacturing an automobile door hinge according to the fourth embodiment and a door-side door hinge that is manufactured by the method of manufacturing an automobile door hinge according to the sixth embodiment.

Figure 47A:
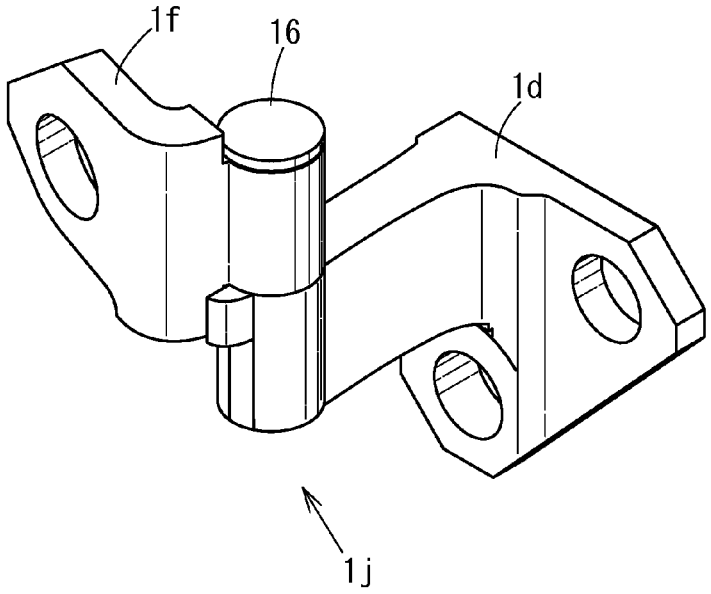
FIG. 47A is a perspective view and FIG. 47B is a front view of a pair of automobile door hinges according to a tenth embodiment of the present invention.
Figure 47B:
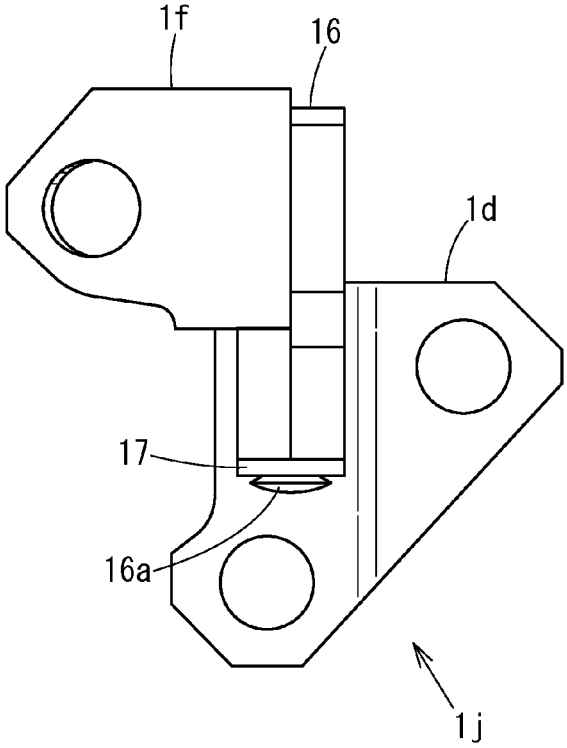

FIGS. 47A and 47B illustrate a pair of automobile door hinges 1*j* that is made from the body-side door hinge 1*d*, which is manufactured by the method according to the fourth embodiment and is attached to an automobile body, and the door-side door hinge 1*f*, which is manufactured by the method according to the sixth embodiment. A headed hinge pin 16 is inserted into the shaft holes in the door hinges 1*d* and 1*f* so that the headed hinge pin extends through the shaft holes. Then, an end portion 16*a* of the headed hinge pin 16 is swaged. Thus, the pair of automobile door hinges 1*j* is made.

A washer 17 is disposed at an end of the headed hinge pin 16.

The method of manufacturing an automobile door hinge according to any of the first to tenth embodiments described above is suitable for manufacturing a door hinge for a large car or a luxury car, which has heavy doors. Needless to say, the methods can be used for small cars and economy cars. In the case of small cars or economy cars, the dimensions specifically described in the above embodiments are made small.

REFERENCE SIGNS LIST

1*a* to 1*d* body-side door hinge
1*e*, 1*f* door-side door hinge
1*g* to 1*j* pair of automobile door hinges
2*a*, 2*c*, 2*e* material
3, 3*c*, 3*f* mounting portion
4 arm portion
5*a*, 5*f* engagement portion
5*b*, 5*e* protrusion-including engagement portion
6 shaft hole
7*a*, 7*c*, 7*f* column portion
7*b*, 7*d*, 7*e* protrusion-including column portion
9 door stop protrusion
16 headed hinge pin
16*a* end portion
30 hot forging step
31 lower die
32 upper die
33*a* to 33*f* forged workpiece
34*a* to 34*f* bent portion
35*a* to 35*f* protruding surface
36*a* to 36*f* concave portion
37*a* to 37*f* opposite surface
38*a* to 38*f* convex portion
40 trimming step
50 shaft hole forming step
51 first punch
52*a* to 52*f* first die
53*a*, 53*c* inner side wall
53*b* gap volume
60 shaft hole finishing step
61 second punch
62*a* to 62*f* second die

The invention claimed is:

1. A method of manufacturing an automobile door hinge through a process including hot forging and punching, the automobile door hinge being made of steel and including a strip-shaped mounting portion, a strip-shaped arm portion that is bent away from the mounting portion, and an engagement portion that is disposed at an end of the arm portion and that has a cylindrical shape, the engagement portion having a shaft hole into which a hinge pin is to be inserted, the method comprising:

a hot forging step of hot forging a round steel bar to form a strip-shaped mounting portion, a strip-shaped arm portion that is bent away from the mounting portion, and a column portion that is disposed at an end of the arm portion and that has a horizontal cross section having a circular or elliptical shape;

a shaft hole forming step of forming a shaft hole, into which a hinge pin is to be inserted, in the column portion formed in the hot forging step by using a first punch and a first die so that the shaft hole extends through an axial center of the column portion; and a shaft hole finishing step of punching the shaft hole formed in the shaft hole forming step by using a second punch and a second die from a side of the shaft hole on which a punching end point exists at which punching with the first punch has been finished, wherein, in the hot forging step, a round steel bar, which has been heated to 950° C. to 1350° C., is placed on a lower die, an upper die is dropped onto the round steel bar a plurality of times, and thereby a forged workpiece having a predetermined shape is formed with the dies, wherein the lower die has a concave portion for receiving a protruding surface on a protruding side of a bent portion of the forged workpiece to be formed in the hot forging step so that the bent portion of the forged workpiece protrudes downward, wherein the upper die has a convex portion whose shape matches that of an opposite surface of the bent portion of the forged workpiece opposite to the protruding surface, wherein a height of the shaft hole formed in the shaft hole forming step in the column portion is 2.0 times a diameter of the shaft hole or larger, wherein the first punch used in the shaft hole forming step includes a tip having a conical shape having a vertex angle in a range of 70° to 120°, wherein the first die has an inner side wall that is separated from an outer periphery of the column portion of the forged workpiece with a gap therebetween, and a gap volume that is provided between the outer periphery of the column portion and the inner side wall has such a size that, during punching of the column portion of the forged workpiece using the first punch, a slug is not generated and the column portion expands outward when the first punch is pressed into the column portion from a punching start point to a predetermined dimension, and a slug is generated and discharged when the first punch is pressed into the column portion from the predetermined dimension to the punching end point, wherein the second die has substantially the same shape as the first die, and wherein the second punch includes a tip having a frusto-conical or conical shape having a vertex angle in a range of 70° to 120°, and the second punch has a maximum diameter that is larger than a maximum diameter of the first punch by 0.1 to 0.3 mm.

2. The method of manufacturing an automobile door hinge according to claim 1, further comprising a trimming step of removing a burr of the forged workpiece formed in the hot forging step by using a trimming press, wherein the trimming step is performed after the hot forging step while the forged workpiece is hot.

3. The method of manufacturing an automobile door hinge according to claim 1, wherein, in the hot forging step, a round steel bar having a temperature in the range of 1200° C.±50° C. is forged.

4. The method of manufacturing an automobile door hinge according to claim 1, wherein the shaft hole forming step is performed by cold working.

* * * * *